US007726798B2

(12) United States Patent
Mattern et al.

(10) Patent No.: US 7,726,798 B2
(45) Date of Patent: Jun. 1, 2010

(54) PRINTER SOLID INK TRANSPORT AND METHOD

(75) Inventors: Frederick T. Mattern, Portland, OR (US); Christopher Ryan Gold, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 752 days.

(21) Appl. No.: 11/640,067

(22) Filed: Dec. 15, 2006

(65) Prior Publication Data

US 2008/0143800 A1 Jun. 19, 2008

(51) Int. Cl.
*B41J 2/01* (2006.01)

(52) U.S. Cl. ..... 347/88; 347/99

(58) Field of Classification Search ..... 347/88, 347/99, 103

See application file for complete search history.

(56) References Cited

U.S. PATENT DOCUMENTS

| | | | | |
|---|---|---|---|---|
| 5,223,860 | A | 6/1993 | Loofbourow et al. | |
| 5,341,164 | A | 8/1994 | Miyazawa et al. | |
| 5,442,387 | A | 8/1995 | Loofbourow et al. | |
| 5,734,402 | A | 3/1998 | Rousseau et al. | |
| 5,784,089 | A | 7/1998 | Crawford | |
| 5,861,903 | A | 1/1999 | Crawford et al. | |
| 5,917,528 | A | 6/1999 | Grellmann et al. | |
| 5,975,690 | A | 11/1999 | Grellmann et al. | |
| 6,053,608 | A * | 4/2000 | Ishii et al. | 347/88 |
| 6,056,394 | A | 5/2000 | Rousseau et al. | |
| 6,170,942 | B1 | 1/2001 | Ogawa et al. | |
| 6,705,710 | B2 | 3/2004 | Jones et al. | |
| 6,739,713 | B2 | 5/2004 | Jones et al. | |
| 6,755,517 | B2 | 6/2004 | Jones et al. | |
| 6,761,443 | B2 | 7/2004 | Jones | |
| 6,824,241 | B2 | 11/2004 | Sonnichsen et al. | |
| 6,840,612 | B2 | 1/2005 | Jones et al. | |
| 6,840,613 | B2 | 1/2005 | Jones | |
| 6,929,360 | B2 | 8/2005 | Jones | |
| 2008/0117265 | A1 * | 5/2008 | Esplin et al. | 347/85 |
| 2008/0136882 | A1 * | 6/2008 | Fairchild et al. | 347/88 |

FOREIGN PATENT DOCUMENTS

| | | |
|---|---|---|
| EP | 1447225 | 8/2004 |

OTHER PUBLICATIONS

EP Search Report, European Patent Office, Apr. 23, 2008.

* cited by examiner

*Primary Examiner*—Manish S Shah
(74) *Attorney, Agent, or Firm*—Maginot, Moore & Beck LLP

(57) ABSTRACT

A solid ink delivery system for use with a ink stick for use in printers is provided. The stick has an external periphery including opposed surfaces of the stick. The solid ink delivery system delivers the stick to a melting unit for melting the stick so that the ink may be transferred to media to form an image on the media. The delivery system includes a guide for guiding the stick in a prescribed path. The guide defines a loading position to permit the stick to be placed in the guide and a delivery position adjacent the melting unit. The guide at the loading position defines constraints for positioning the stick. A portion of the constraints, including a shaped insertion opening, is adapted for cooperation with the opposed surfaces of the external periphery of the stick. At least one of the constraints defining a grasping recess in the constraint for providing access to a portion of at least one of the opposed surfaces of the external periphery of the stick.

18 Claims, 28 Drawing Sheets

PRINTER SOLID INK TRANSPORT AND METHOD

1. TECHNICAL FIELD

The system disclosed herein generally relates to high speed printers which have one or more printheads that receive molten ink heated from ink sticks or pellets. More specifically, the system disclosed herein relates to improving the ink transport system design and functionality.

2. BACKGROUND OF RELATED ART

So called "solid ink" printers encompass various imaging devices, including printers and multi-function platforms and offer many advantages over many other types of high speed or high output document reproduction technologies such as laser and aqueous inkjet approaches. These often include higher document throughput (i.e., the number of documents reproduced over a unit of time), fewer mechanical components needed in the actual image transfer process, fewer consumables to replace, sharper images, as well as being more environmentally friendly (far less packaging waste).

A schematic diagram for a typical solid ink imaging device is illustrated in FIG. 1. The solid ink imaging device, hereafter simply referred to as a printer 100 has an ink loader 110 which receives and stages ink sticks which remain in solid form at room temperatures. The ink stock can be refilled by a user by simply adding more ink as needed to the ink loader 110. Separate loader channels are used for the different colors. For, example, only black ink is needed for monochrome printing, while ink colors of black, cyan, yellow and magenta are typically needed for color printing. Each color is loaded and fed in independent channels of the ink loader.

An ink melt unit 120 melts the ink by raising the temperature of the ink sufficiently above its melting point. During a melting phase of operation, the leading end of an ink stick contacts a melt plate or heated surface of the melt unit and the ink is melted in that region. The liquefied ink is supplied to a single or group of print heads 130 by gravity, pump action, or both. In accordance with the image to be reproduced, and under the control of a printer controller (not shown), a rotating print drum 140 receives ink droplets representing the image pixels to be transferred to paper or other media 170 from a sheet feeder 160. To facilitate the image transfer process, a pressure roller 150 presses the media 170 against the print drum 140, whereby the ink is transferred from the print drum to the media. The temperature of the ink can be carefully regulated so that the ink fully solidifies just after the image transfer.

While there may be advantages to the use of solid ink printers compared to other image reproduction technologies, high speed and voluminous printing sometimes creates problems not satisfactorily addressed by the prior art solid ink printing architectures. To meet the large ink volume requirement, ink loaders must have large storage capacity and be able to be replenished by loading ink at any time the loader has capacity for additional ink.

In typical prior art ink chuck or stick reservoirs, the sticks are positioned end to end in straight or linear channel or chute with a melt head on one end and a spring biased push stick on the other end. As these solid ink printers have high productivity rates, the storage of ample supplies of ink is very desirable. As the space in solid ink printers is limited, finding a location within the printer to accommodate a long straight chute for holding an ample supply of ink is a challenge. The amount of ink that can be accommodated is limited by the physical dimensions of the printer and can not be greater that the amount accommodated by a linear chute diagonally positioned in the printer.

To assure that the proper ink stick is inserted into a printer, the ink sticks may have an irregular shape which provides a key for moving the sticks by a corresponding key formed in the loading position of the printer. Since the ink sticks have this keying feature, once the ink stick has passed through the closely matched keyed opening, the ink sticks may not be retrieved easily. The planar keying surface is above the top of the ink when the ink is fully inserted. Removal of the ink stick when necessary requires the use of a tool or sharp object which must be impaled into the top surface of the ink stick. The impaling of the ink stick may create an issue when later trying to use the stick as it may crack or shed material. Further, the tool or object may not be readily available for the user and the user may not be aware of such a procedure to remove the ink stick.

3. SUMMARY

In view of the above-identified problems and limitations of the prior art and alternate ink and ink loader forms, the system disclosed herein provides a solid ink supply system adapted for use with printers.

In one embodiment of the system disclosed herein, a solid ink delivery system for use with a solid ink stick for use in printers is provided. The stick has an external periphery including opposed surfaces of the stick. The solid ink delivery system delivers the stick to a melting unit for melting the stick so that the ink may be transferred to media to form an image on the media. The delivery system includes a channel or chute which acts as a guide for guiding the stick in a prescribed path. The guide chute (or simply guide) defines a loading position to permit the stick to be placed in the guide and a delivery position adjacent the melting unit. The guide at the loading position defines constraints for positioning the stick. A portion of the constraints, including a shaped insertion opening is adapted for cooperation with the opposed surfaces of the external periphery of the stick. At least one of the constraints defining at least one recess for providing grasping access to a portion of at least one of the opposed surfaces of the external periphery of the stick.

In another embodiment of the system disclosed herein, a printer including a solid ink delivery system for use with a solid ink stick is provided. The stick has an external periphery including opposed surfaces of the stick. The solid ink delivery system delivers the stick to a melting unit for melting the stick so that the ink may be transferred to media to form an image on the media. The delivery system includes a guide for guiding the stick in a prescribed path. The guide defines a loading position to permit the stick to be placed in the guide and a delivery position adjacent the melting unit. The guide at the loading position defines constraints for positioning the stick. A portion of the constraints, including a shaped insertion opening is adapted for cooperation with the opposed surfaces of the external periphery of the stick. At least one of the constraints defines at least one recess for providing grasping access to a portion of at least one of the opposed surfaces of the external periphery of the stick.

In yet another embodiment of the system disclosed herein, a method of advancing solid ink in a printer toward a melt station is provided. The method includes the step of providing at least one ink stick defining a longitudinal axis of the stick and an external periphery of the stick. The method also includes the step of providing a guide for guiding the stick in a prescribed path. The guide defines a loading position and a delivery position adjacent the melting unit. The guide at the loading position defines constraints for positioning the stick. A portion of the constraints, including a shaped insertion opening cooperates with the opposed surfaces of the external periphery of the stick. At least one of the constraints defines at least one recess through the constraint. The method also includes the steps of inserting the stick into the guide at the loading position and determining if the inserted stick needs to be removed from the loading position. The method also includes the step of accessing the inserted stick through at least one constraint recess by grasping the stick if the inserted stick needs to be removed from the loading position.

The system disclosed herein is fundamentally an ink delivery system for printers that may use gravity and/or a driver, for example in the form of a belt, to advance the ink from the loading station to the melting station where molten ink can be transferred to one or more print heads. The many additional described features of this ink delivery system, which can be selectively incorporated individually or in any combination, enable many additional printer system opportunities, including improved usability lower cost, enlarged ink storage capacity, as well as more robust feed reliability.

4. BRIEF DESCRIPTION OF THE DRAWINGS

Features of the system disclosed herein will become apparent to those skilled in the art from the following description with reference to the drawings, in which.

Figure 1:
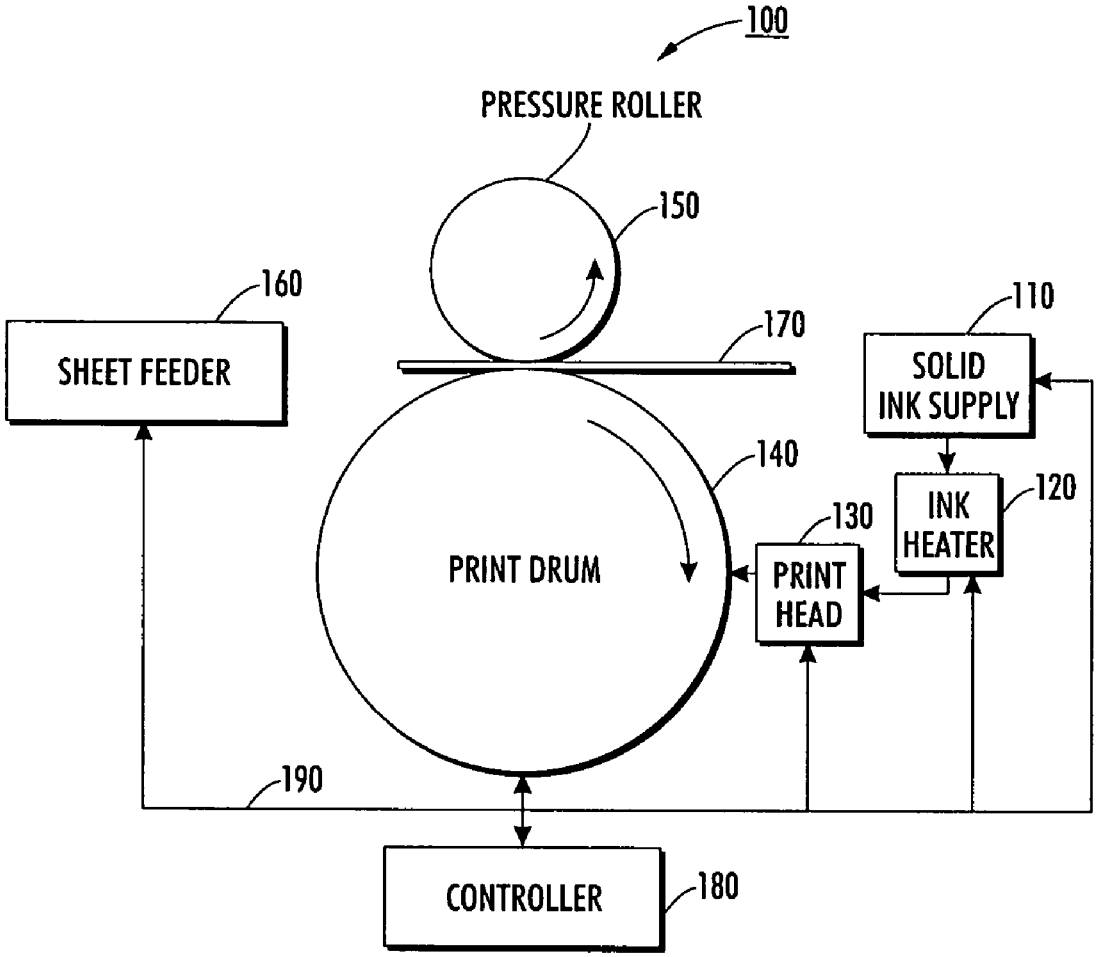
FIG. 1 PRIOR ART
FIG. 1 is a general schematic diagram of a prior art high speed, solid ink printer.
Figure 2:
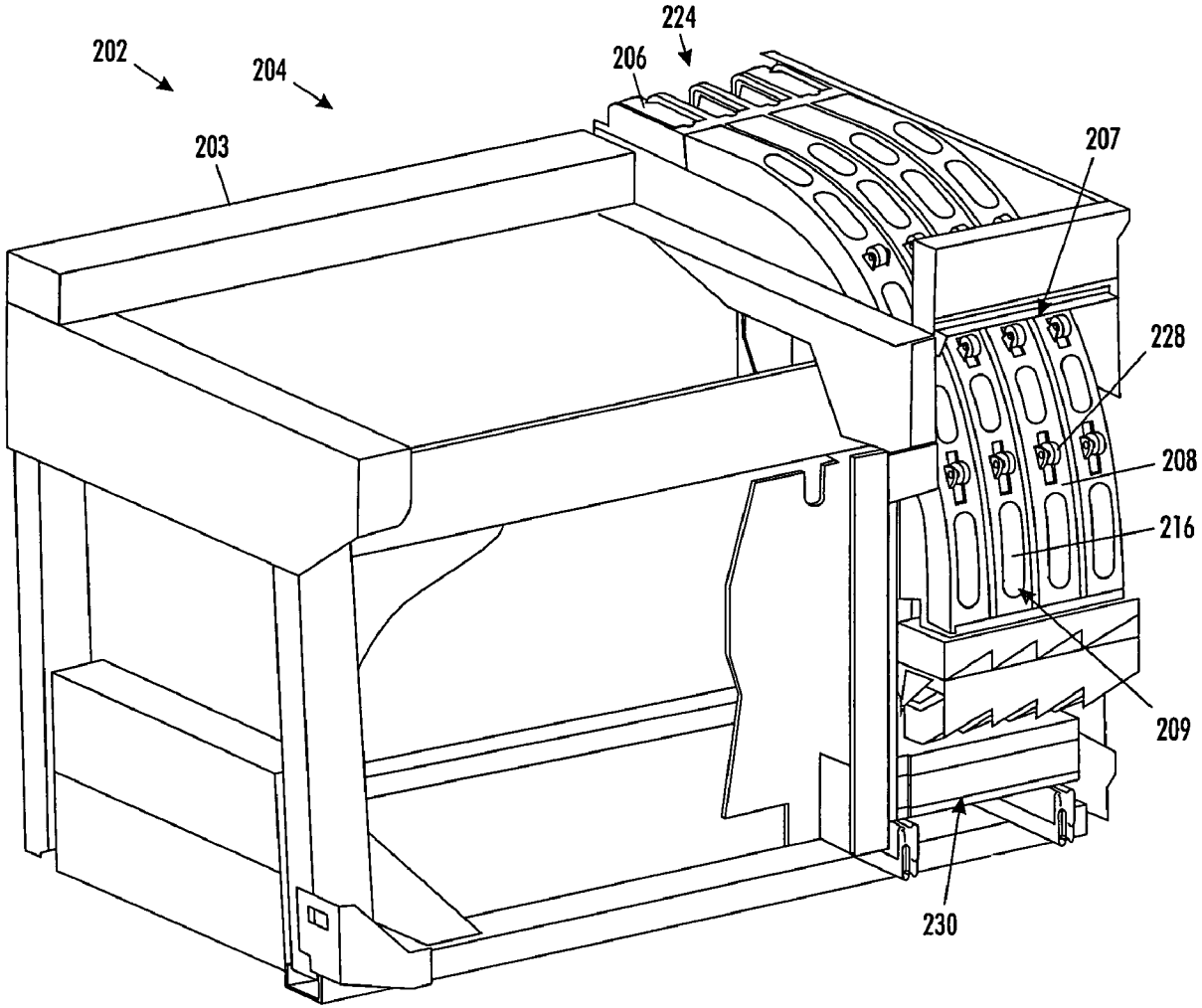
FIG. 2 is a cutaway perspective view of an embodiment of a solid ink delivery system in position in a solid ink printer for delivering ink to printheads of the solid ink printer.
Figure 10:
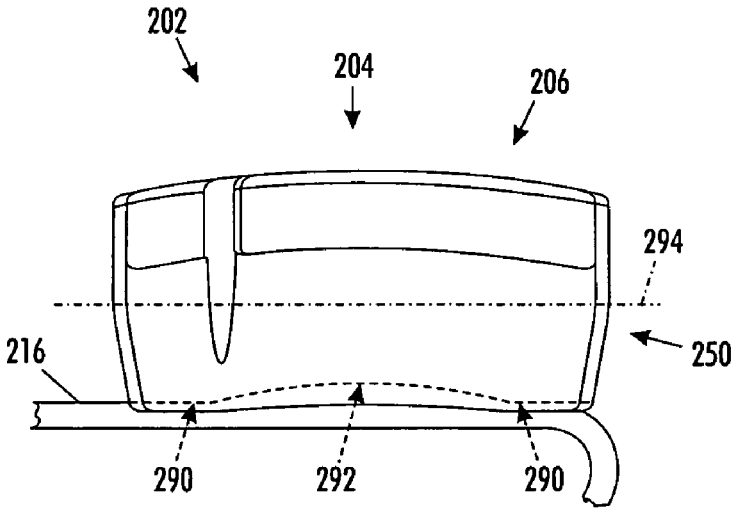
FIG. 10 is a plan view of the ink stick of FIG. 9 in position on a flat portion of the drive member of FIG. 7.
Figure 25:
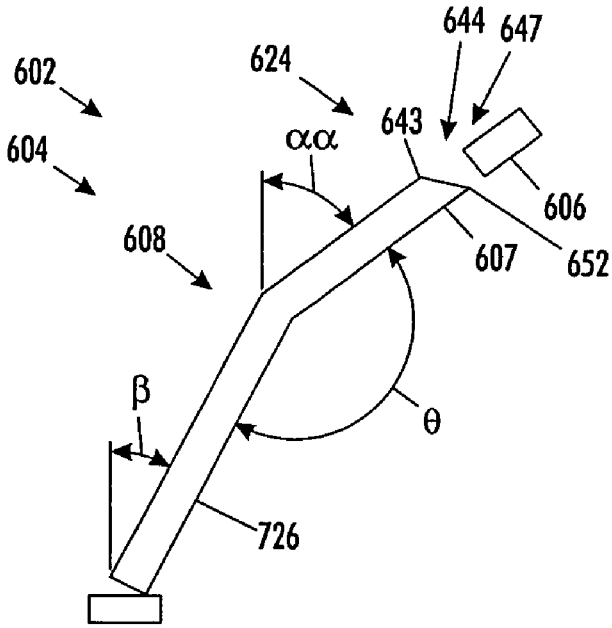
Figure 26:
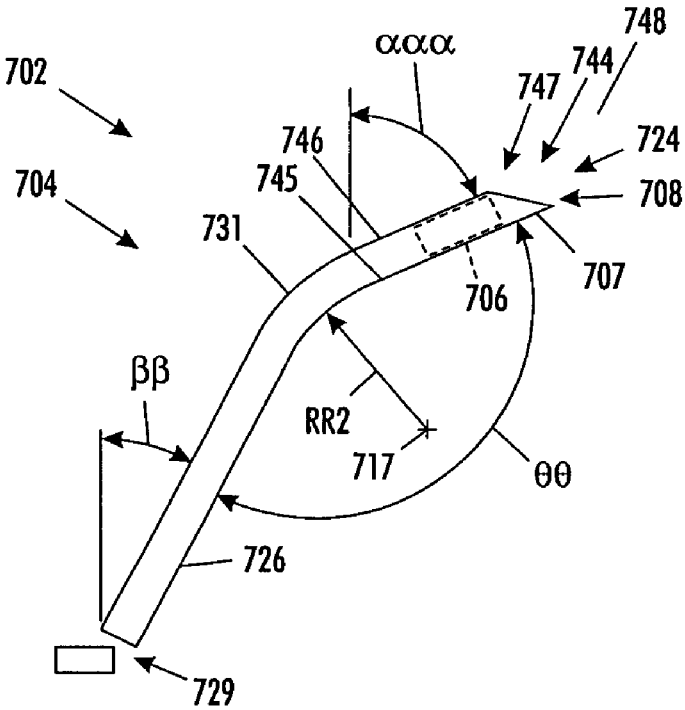
Figure 27:
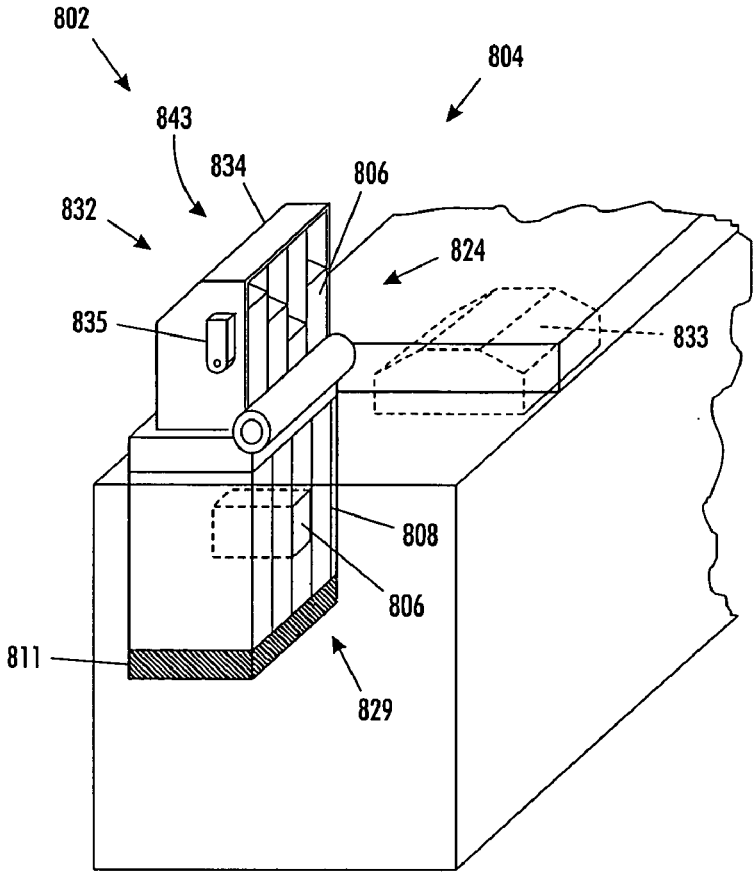
Figure 28:
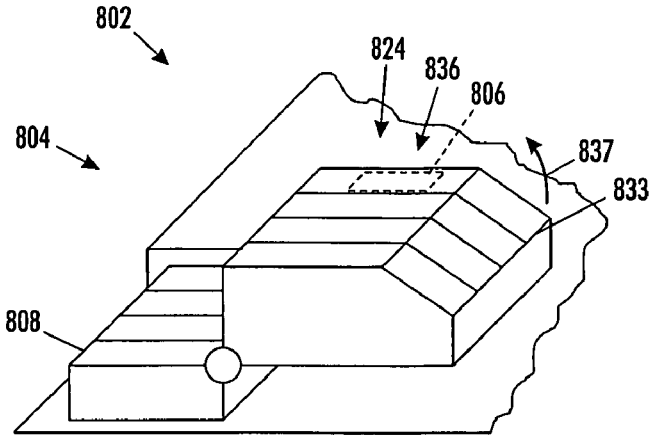
Figure 29:
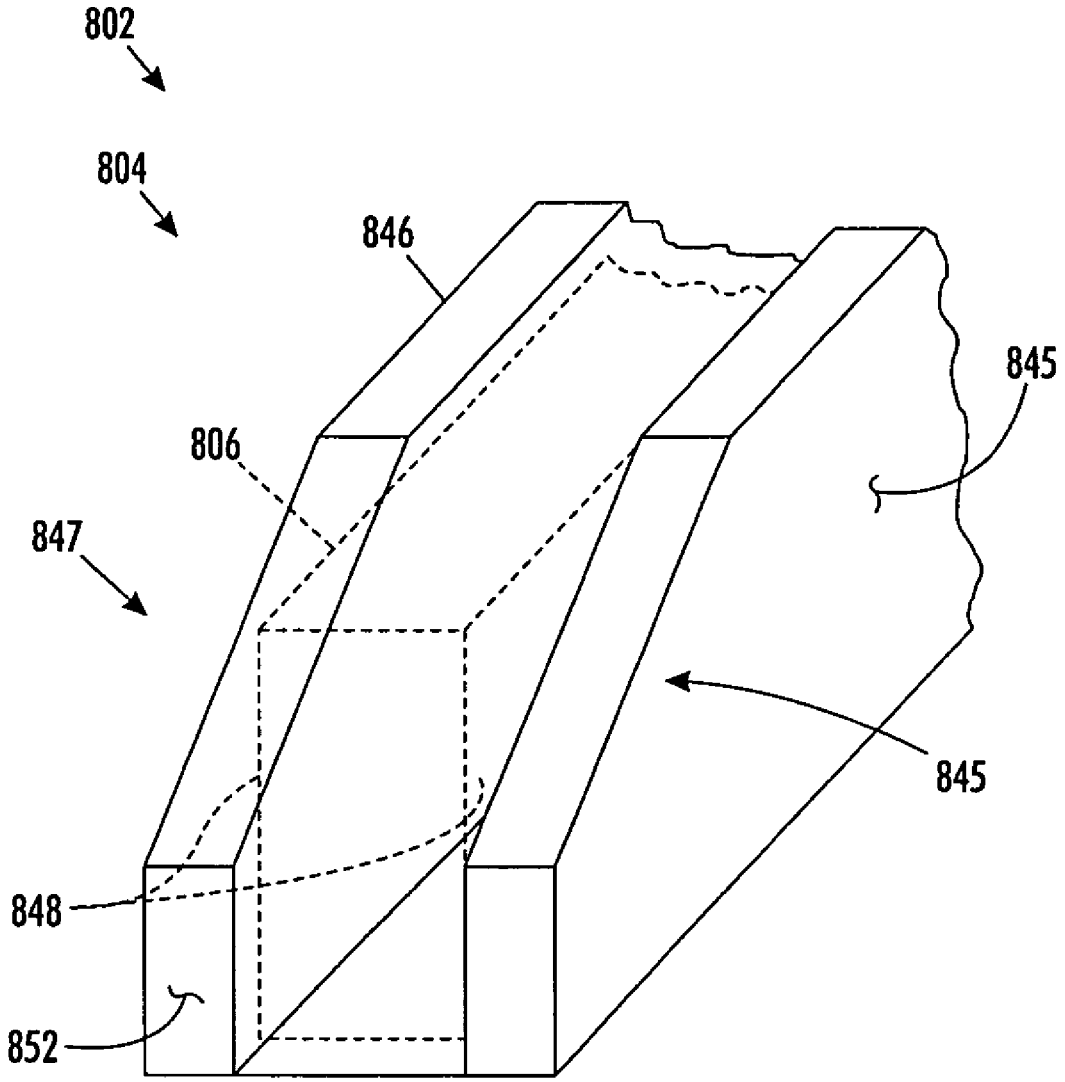
Figure 30:
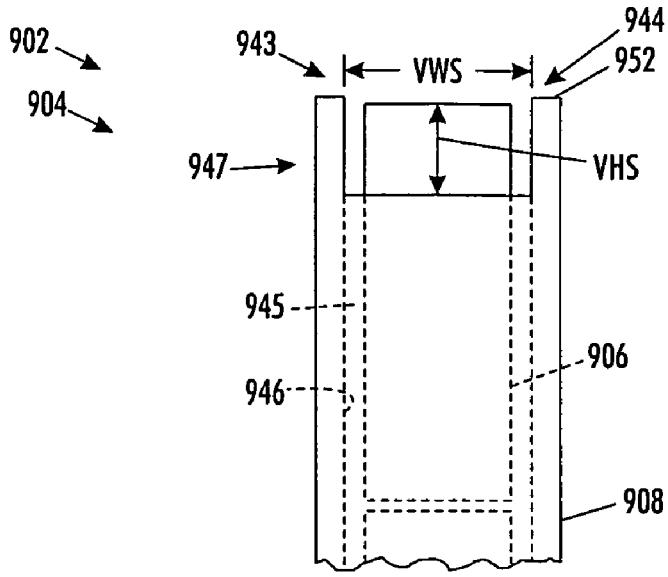
Figure 31:
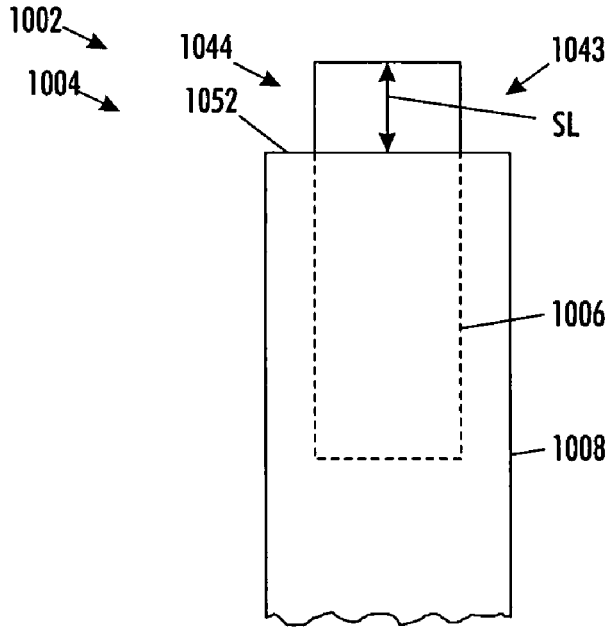
Figure 32:
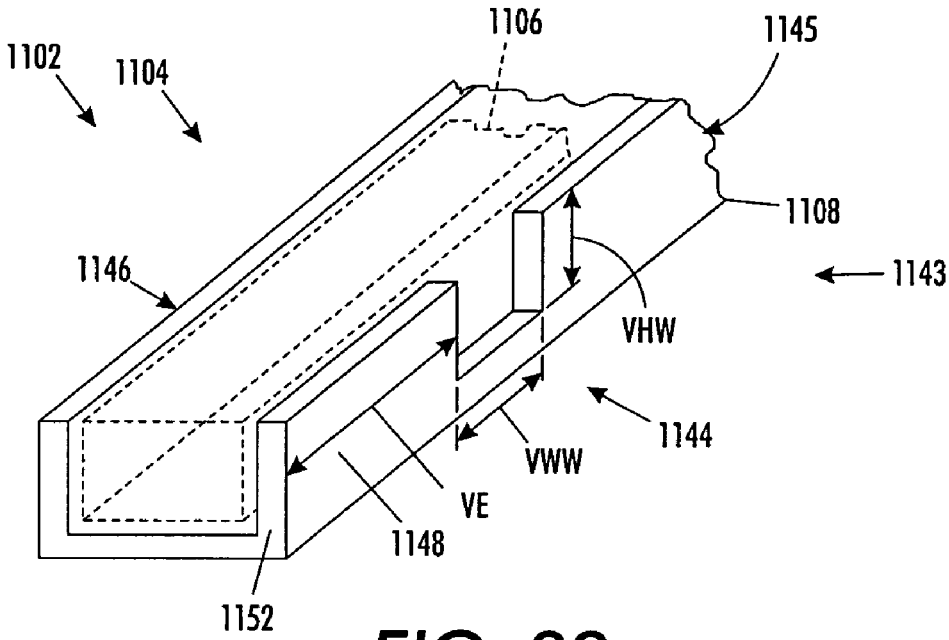
Figure 33:
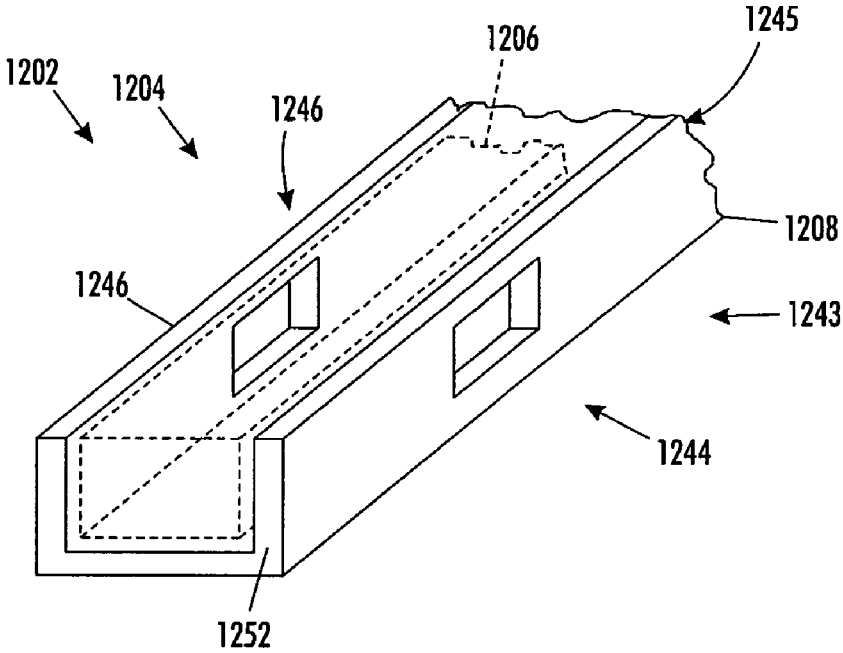
Figure 34:
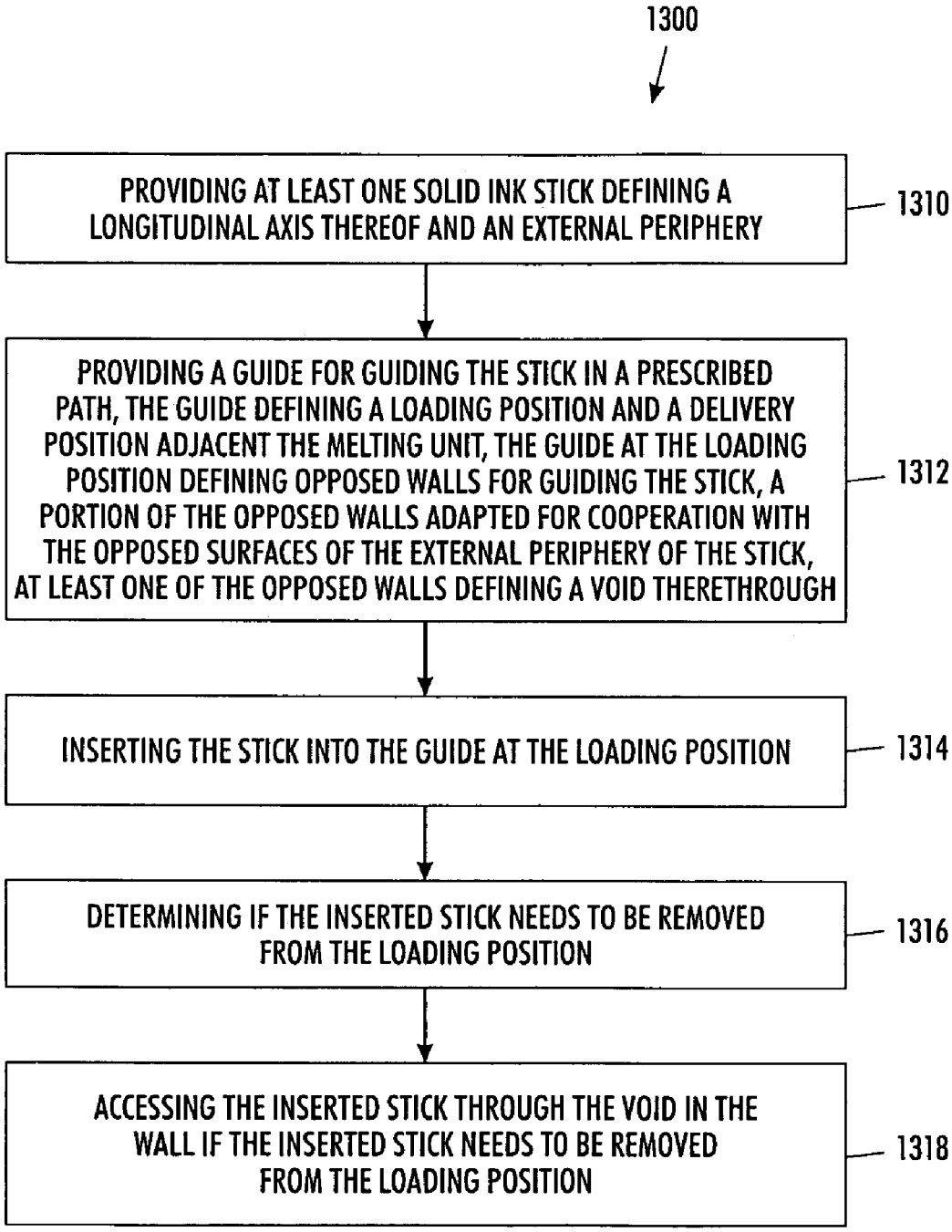
Figure 35:
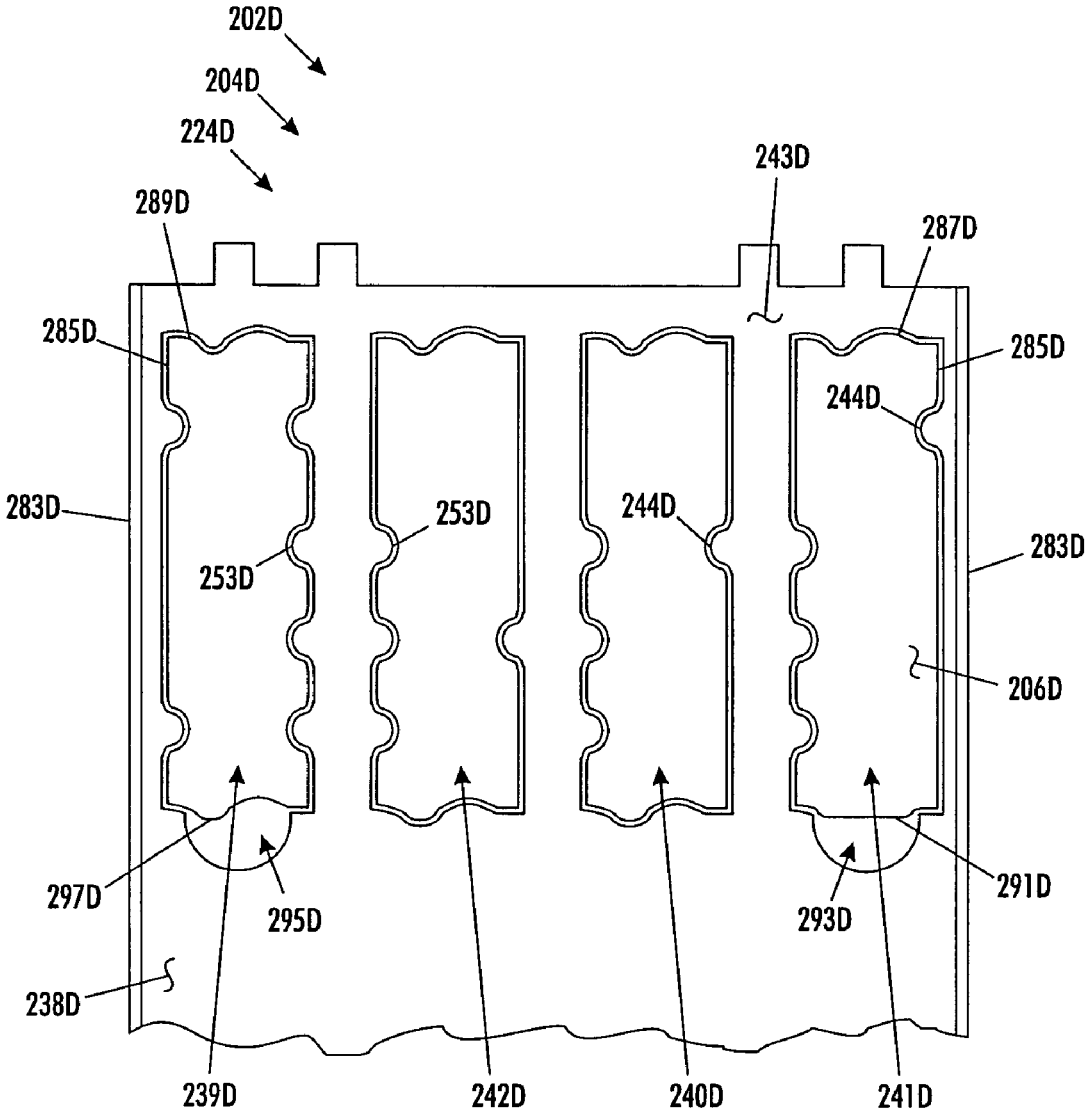
Figure 36:
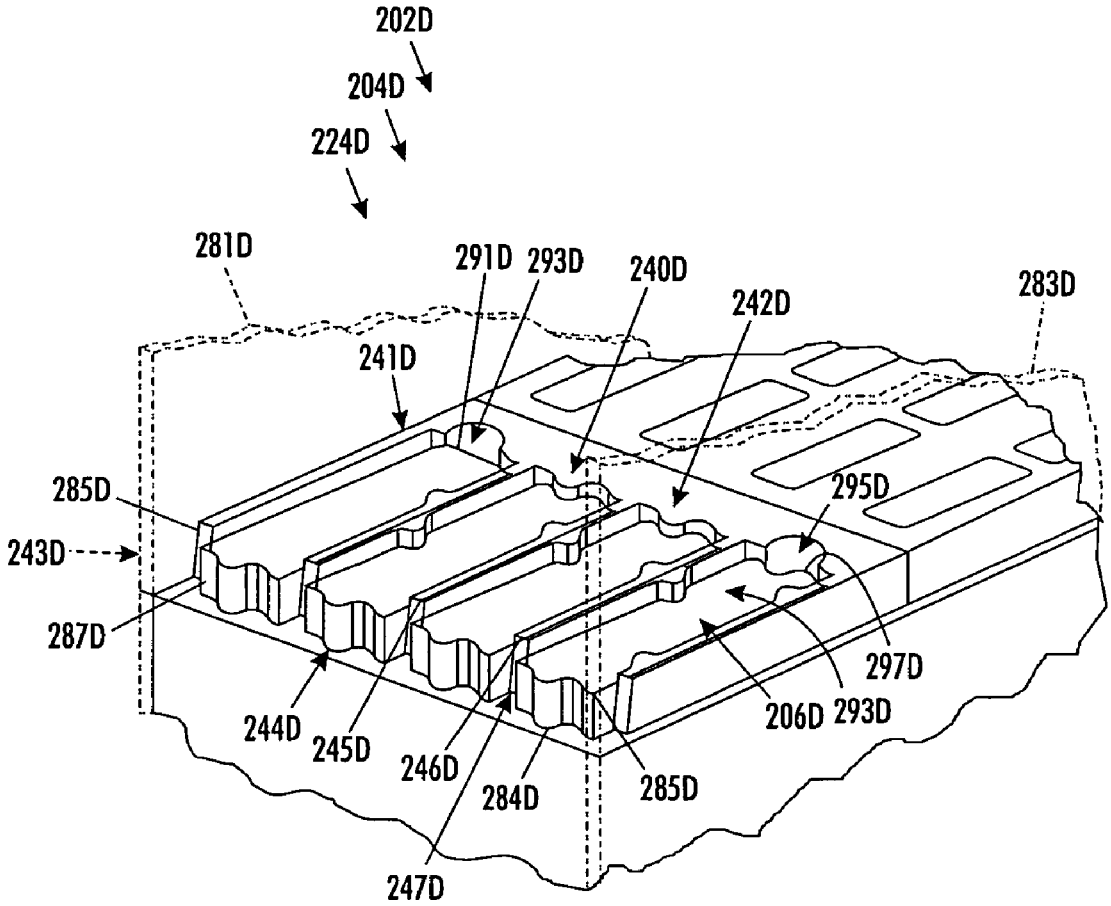

FIG. 25 is a plan view of a further embodiment of the solid ink delivery system of the system disclosed herein in the form of a solid ink delivery system with a chute having a first linear portion and a second linear portion and showing a triangularly formed grasping recess at the end of the chute for inserting and/or retrieving a stick from the chute at the loading station; and FIG. 26 is a plan view of a further embodiment of the solid ink delivery system of the system disclosed herein in the form of a solid ink delivery system with a chute having a first linear portion, a curved portion and a second linear portion and showing a triangularly formed grasping recess at the end of the chute for inserting and retrieving a stick from the chute at the loading station;

FIG. 27 is a partial perspective view of a further embodiment of the solid ink delivery system of the system disclosed herein with a chute that has a lower portion that is straight and perpendicular to the work surface of the ink printing machine and an upper portion pivotably connected to the lower portion;

FIG. 28 is a partial perspective view of the solid ink delivery system of FIG. 10 showing the upper portion in a loading position;

FIG. 29 is a plan view of the loading station of the solid ink delivery system of FIGS. 27 and 28 showing a triangularly formed grasping recess through one side constraint at the end of the vertical chute for inserting and retrieving a stick from the chute at the loading station according to another embodiment of the system disclosed herein;

FIG. 30 is a plan view of the loading station of a solid ink delivery system showing one side of a two sided grasping recess at the end of a vertical chute for inserting and retrieving a stick from the chute at the loading station according to another embodiment of the system disclosed herein;

FIG. 31 is a plan view of the loading station of a solid ink delivery system showing a four sided grasping recess at the end of the chute for inserting and retrieving a stick from the chute at the loading station according to another embodiment of the system disclosed herein;

FIG. 32 is a partial perspective view of another embodiment of the solid ink delivery system of the system disclosed herein with a recess in a side constraint of the chute;

FIG. 33 is a partial perspective view of another embodiment of the solid ink delivery system of the system disclosed herein with recessed openings through the side constraints of the chute;

FIG. 34 is a flow chart of a method for printing with ink sticks in accordance with another embodiment of the system disclosed herein;

FIG. 35 is a top view of a loading station of a solid ink delivery system similar to that of FIG. 2 showing a triangularly formed grasping recess at the end of the chute, constraints for inserting and/or retrieving a stick from the chute at the loading station and finger recesses for the some the ink sticks according to the system disclosed herein; and FIG. 36 is a perspective view of the loading station of FIG. 35.

5. DETAILED DESCRIPTION

The term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a printhead are intended to encompass the range of heaters, intermediate connections, tubes, manifolds and/or other components and/or functions that may be involved in a printing system but are not immediately significant to the system disclosed herein.

The general components of a solid ink printer have been described supra. The system disclosed herein includes a solid ink delivery system and a solid ink printer and a method for incorporating the same. Various terms may be used to describe the same part, guide or chute for example when referring to the feed channel and structure that stages ink sticks and ensures the sticks are confined to the load position and feed path of the ink delivery system. The constraining elements of the chute or guide may be in the form of a keyed insertion opening in a panel or plate, confining walls, ribs, gussets, fences, barriers or other restraints that exclude, admit, position or confine the ink stick in a location that allows it to progress in the feed direction but prevents or inhibits unintended dislocation. Such elements will be termed constraints or walls. Walls are depicted as being fully or nearly fully encircling configurations, excepting the insertion opening and grasping recesses, but they need not be so configured. Grasping recesses are generally depicted as being rectangular or triangular for simplicity but they can be of any shape and for aesthetic, function or fabrication reasons may be rounded, smoothly contoured or have sharp corners or edges or any combination.

According to the system disclosed herein and referring now to FIG. 2, an embodiment of the solid ink printer with the solid ink delivery system of the system disclosed herein is shown as printer 202. The printer 202 is a multi-color printer. The printer 202 utilizes four separate color ink sticks 206 which have respectively the colors black, cyan, magenta and yellow. The printer 202 of FIG. 2 also has a chute 208 that includes an arcuate portion 207 to increase the stick capacity of the chute 208. The arcuate portion may be comprised of a single or multiple arc axes, including continuously variable 3 dimensional arc paths, any combination of which can be of any length relative to the full arcuate portion. The term arcuate refers to these and any similar, non linear configuration. A monochrome version of this printer might have multiple channels of black ink or may have various shades of gray, white or neutral in addition to black. The configuration shown and described is a four color configuration but this could be six colors or any other practical number, including multiple channels of one or more specific colors. Imaging might be on surfaces atypical of normal printing on or transfer to media, such as directly on products or packaging materials.

The printer 202, as shown in FIG. 2, has a frame 203 which is used to support the solid ink delivery system 204. The solid ink delivery system 204 advances the sticks 206 from loading station 224 near the top of the solid ink printer 202 to melting station 230 near the bottom of the printer 202. The printer 202 includes a plurality of chutes 208. A separate chute 208 is utilized for each of the four colors: namely cyan, magenta, black and yellow.

As shown in FIG. 2, the chutes 208 may include longitudinal openings 209 for viewing the progress of the sticks 206 within the chutes 208 and also to reduce cost and weight. Nudging members 228 may be positioned along the chute 208 for nudging the sticks 206 against belt 216.

Figure 3:
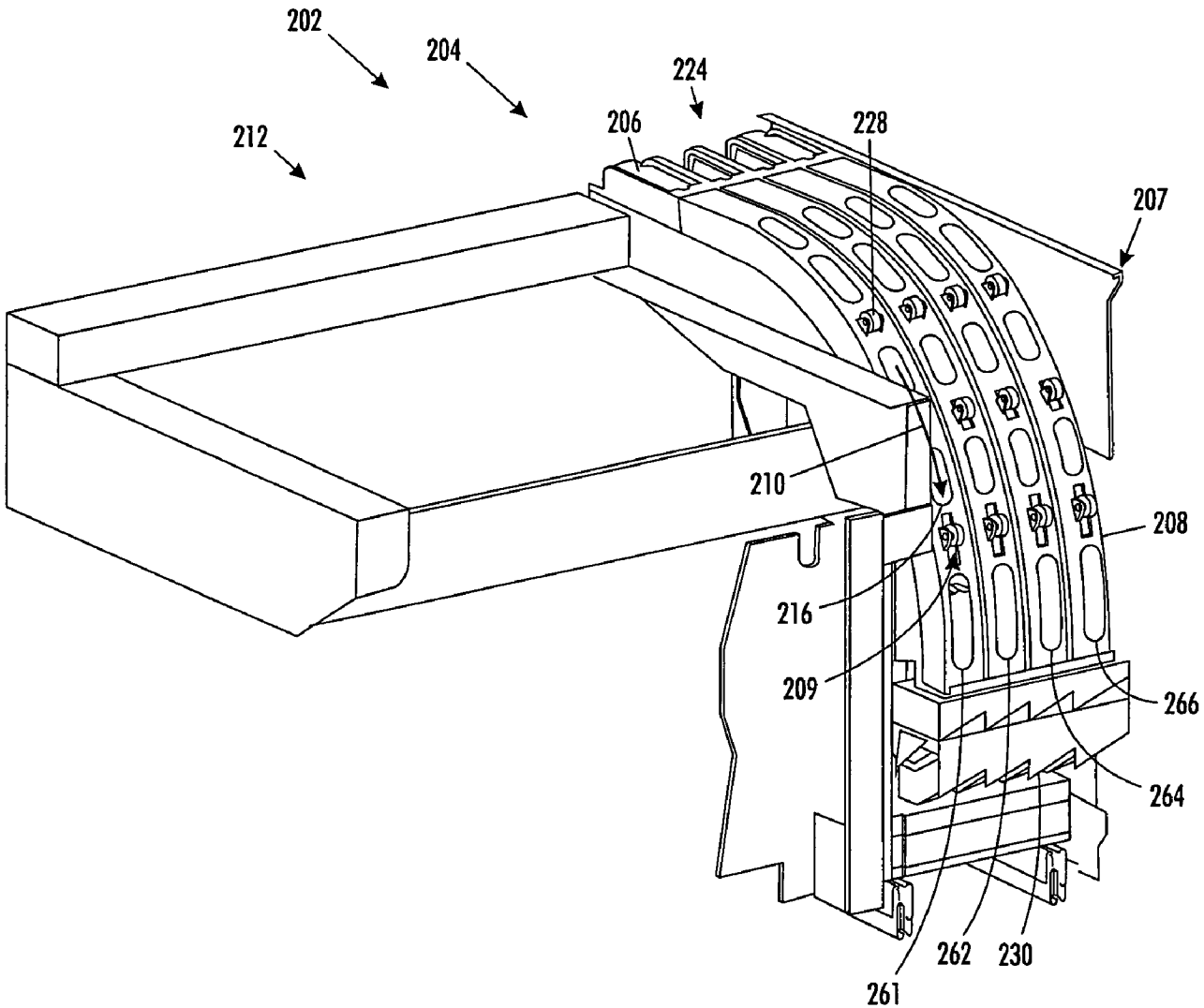
FIG. 3 is a partial cutaway perspective view of the solid ink delivery system of FIG. 2 in position in a solid ink printer for delivering ink to printheads of the printer, showing the ink delivery system in greater detail.
Figure 4:
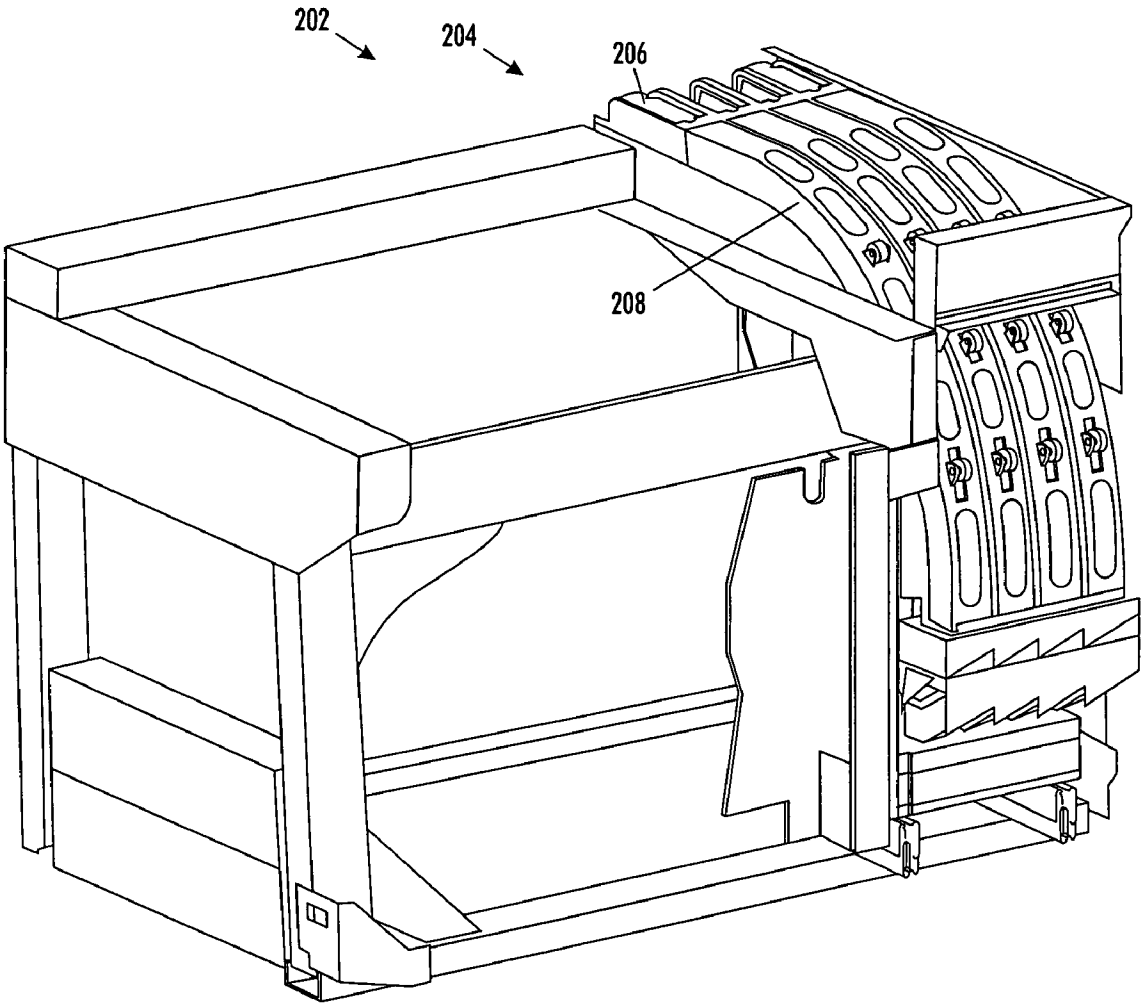
FIG. 4 is another perspective view of the solid ink delivery system of FIG. 2 in position in a solid ink printer for delivering ink to printheads of the printer.

Referring now to FIGS. 3 and 4, the solid ink delivery system 204 of the printer 202 is shown in greater detail. The solid ink delivery system 204 incorporates separate solid ink delivery sub-systems, each consisting, in part, of a load or receiving section, a feed chute and a melt unit. For example, and as is shown in FIGS. 3 and 4, the solid ink delivery system 204 includes a black ink delivery sub-system 261.

The solid ink delivery system 204 further includes a second, third and fourth solid ink delivery sub-system 261, 264 and 266 providing for cyan, yellow and magenta ink sticks, respectively. The colors have been described in a specific sequence but may be sequenced in any order for a particular printer. Keyed insertion openings define which color will be admitted into a sub-system color chute of the solid ink delivery system 304. Each of the solid ink delivery sub-systems 261, 262, 264 and 266 may be positioned parallel to each other and may have similar components. For simplicity, the black solid ink delivery sub-system 261 will be described in greater detail. It should be appreciated that the other sub-systems 262, 264 and 266 have similar components and operate similarly to the black solid ink delivery sub-system 261.

The black solid ink delivery sub-system 261 includes the guide in the form of chute 208 for holding a number of ink sticks 206 and guiding them in a prescribed path 210 from loading station 224 to the melting station 230. The chute 208 may have an insertion opening with any suitable shape such that only one color of s an ink stick set may pass through the opening. The black solid ink delivery sub-system 261 further includes a drive member in the form of belt 216 which provides for engagement with a plurality of the ink sticks 206 and extends along a substantial portion of the prescribed path 210 of the black solid ink delivery sub-system 261. As shown in FIGS. 3 and 4, the belt 216 engages more than one stick at a time. The belt 216 may simultaneously contact several sticks 206, each stick positioned at a different place in the chute.

Figure 5:
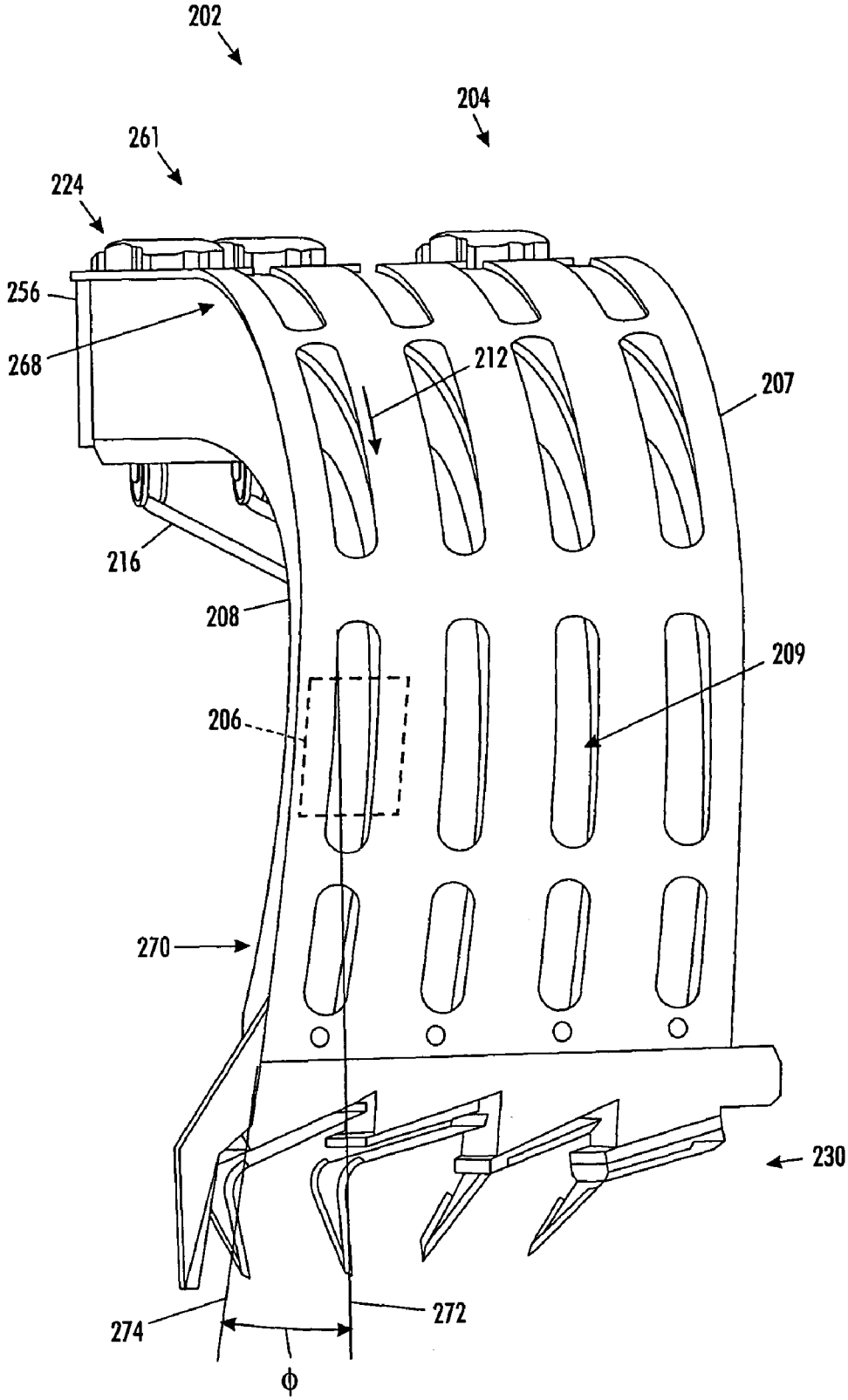
FIG. 5 is a perspective view of the guide assembly of the solid ink delivery system of FIG. 2 for advancing the ink sticks of the solid ink delivery system toward the melting station of the delivery system.
Figure 6:
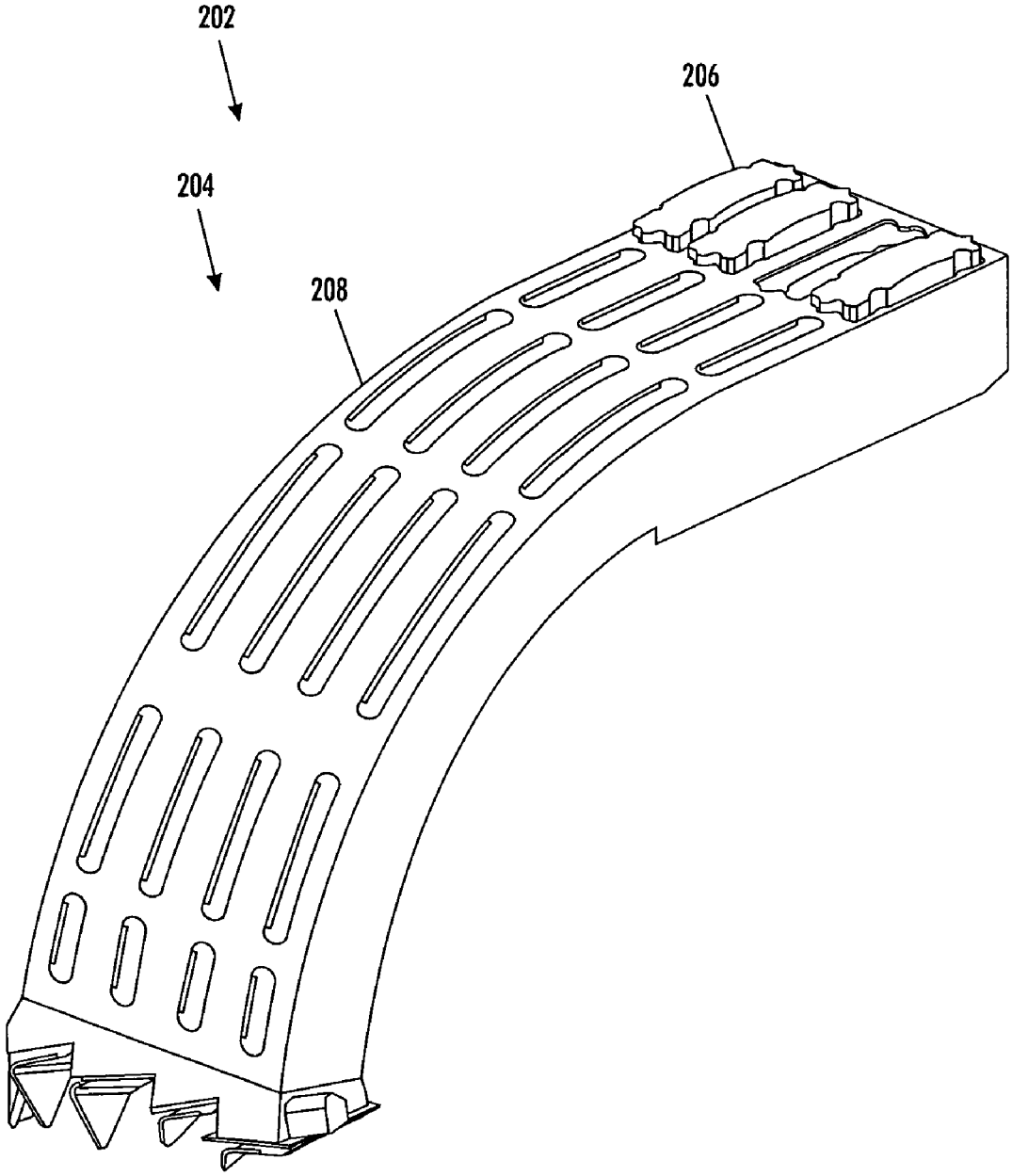
FIG. 6 is another perspective view of the guide assembly of the solid ink delivery system of FIG. 2 for advancing the ink sticks of the solid ink delivery system toward the melting station of the delivery system.

While the chute 208 may have any suitable shape, for example, and as shown in FIGS. 5 and 6, the chute 208 may include a first linear portion 268 adjacent the loading station 224. As shown in FIGS. 5 and 6, the first linear portion 268 may be substantially horizontal such that the ink stick 206 may be inserted into the end 256 of the chute 208 in a simple horizontal motion in the top of the printer 202.

To better utilize the space within the printer 202, the chute 208 may have a shape that is not linear such that a greater number of ink sticks 206 may be placed within the printer 202 than the number possible with a linear chute. For example, and as shown in FIGS. 5 and 6, the chute 208 may include, in addition to the first linear portion 268, arcuate portion 207 extending downwardly from the first linear portion 268 of the chute 208. The chute 208 may further include a second linear portion 270 extending downwardly from the arcuate portion 207 of the chute 208. The second linear portion 270 may be substantially vertical and be positioned over the melting station 230 such that the ink sticks 206 may be delivered to the melting station 230 by gravity.

The chute may lay within a single plane, for example, plane 272. Alternatively, and as shown in FIGS. 5 and 6, the chute 208 may extend through a series of non-parallel planes. For example, and as shown in FIG. 5, the chute 208 may move downwardly and outwardly to an angled plane 274 which is skewed with respect to the vertical plane 272. The planes 272 and 274 form an angle (p there between. The angle $\phi$ may be any angle capable of providing for a larger number of ink sticks 206 in chute 208.

Figure 7:
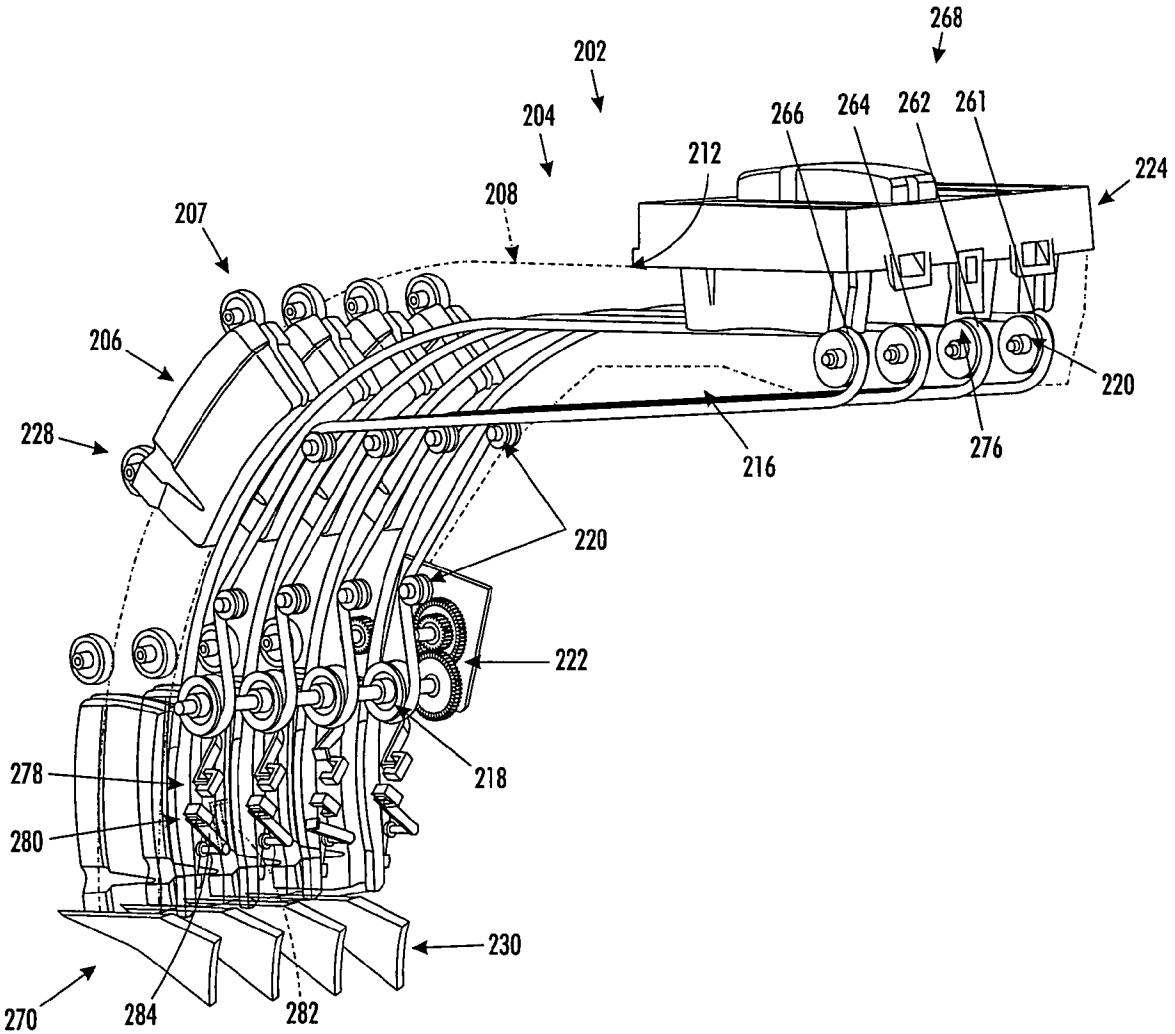
FIG. 7 is another perspective view of the guide assembly of the solid ink delivery system of FIG. 2 including the drive member for advancing the ink sticks of the solid ink delivery system toward the melting station of the delivery system.

Referring now to FIG. 7, the drive belt 216 of the solid ink delivery system 204 of the printer 202 is shown in greater detail. The drive belt 216 may require that a portion of the belt 216 have a shape to conform to the chute 208. The conforming shape may be in the arcuate portion 207 of the chute 208, as well as in the first linear portion 268 and the second linear portion 270 of the chute 208. The belt 216 may be driven, for example, by a motor transmission assembly 222 which is used to rotate drive pulley 218.

The drive belt 216 may for example have a circular cross section and be a continuous belt extending from the drive pulley 218 through a series inlet idler pulleys 220 and chute 208. Nudging members 228 in the form of, for example, pinch rollers may be spring loaded and biased toward the belt 216 to assure sufficient friction between the belt 216 and the ink sticks 206 such that the ink sticks do not fall by gravity and slip away from the belt 216.

The solid ink delivery system 204 of the printer 202 may further include a series of sensors for determining the presence or absence of the ink sticks 206 within different portions of the chute 208. An inlet sensor assembly 276 may be used to indicate that additional ink sticks 206 may be added to the chute 208 when a previously inserted stick is advanced sufficiently. The inlet sensor assembly 276 may be positioned near loading station 224. A low sensor assembly 278 may be used to indicate a low quantity of ink sticks 206 in the chute 208. The low sensor assembly 278 may be positioned spaced from the melt station 230.

An out sensor assembly 280 may be used to indicate the absence of ink sticks 206 in the chute 208, excepting any remaining unmeltable ink volume. The out sensor assembly 280 may be positioned adjacent to the melt station 230. The sensor assemblies 276, 278 and 280 may have any suitable shape and may, for example, and as is shown in FIG. 6, be in the form of pivoting flags or sensors that pivot about a wall of the chute 208 and transition a switch, such as a micro switch or an optical interrupter. The presence of a stick 206 causes the sensors to move from first position 282, as shown in phantom, to second position 284, as shown in solid. A sensor or switch may be used to determine whether the sensors 276, 278 or 280 are in the first position 282 or in the second position 284. Other sensing devices may be used in conjunction with or in place of a mechanical flag system, such as a proximity switch or reflective or retro-reflective optical sensor.

Figure 8:
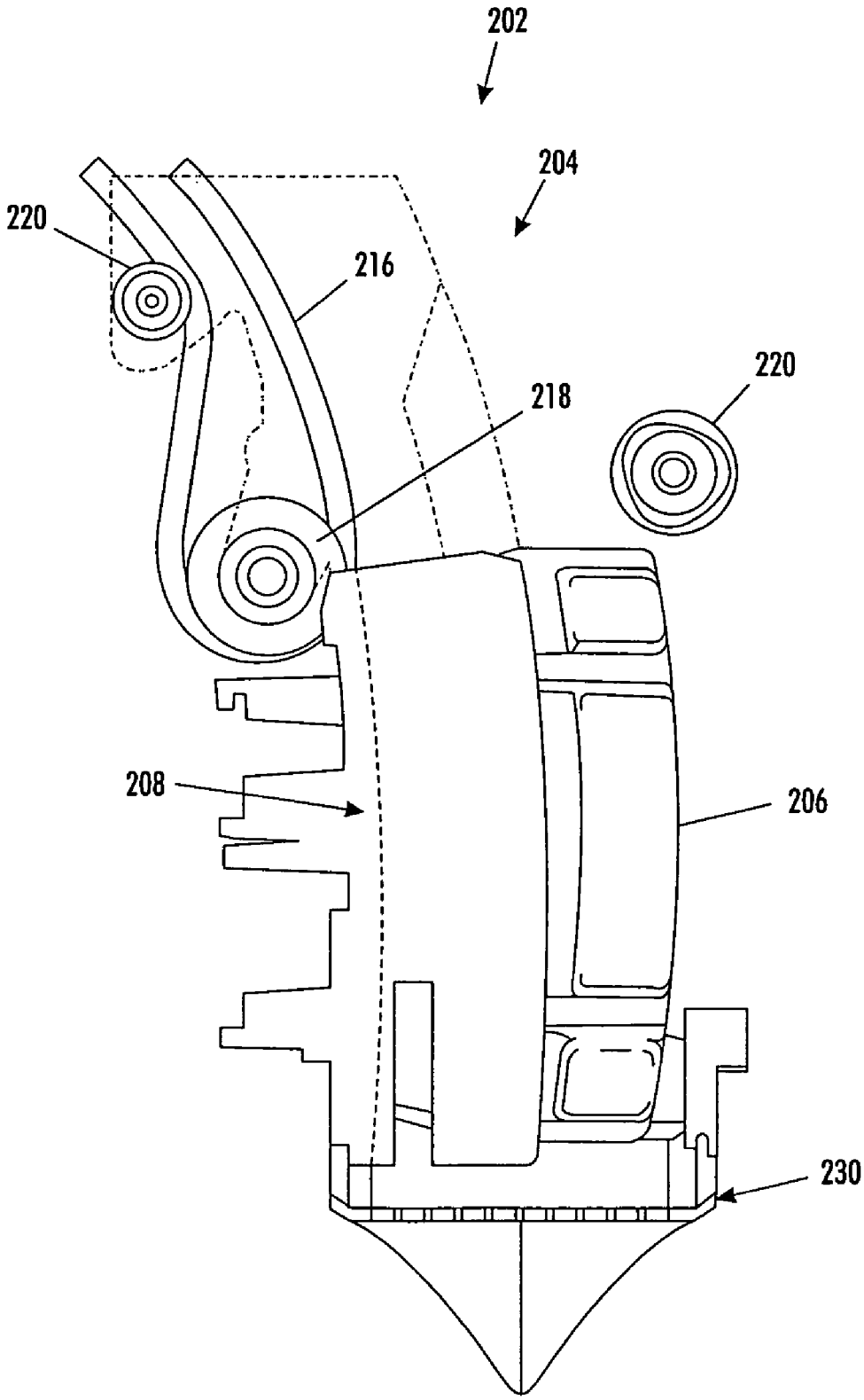
FIG. 8 is partial perspective view of the guide assembly including the drive member for advancing the ink sticks of the solid ink delivery system of FIG. 2 showing the portion adjacent the melt station in greater detail.

Referring now to FIG. 8, the solid ink delivery system 204 of the printer 202 is shown in the location around the melt station 230. As shown in FIG. 8, the drive pulley 218 and the belt 216 are positioned somewhat away from the ink stick 206 when the ink stick 206 is in the melt station 230. The spacing of the belt 216 away from the ink stick 206 when the ink stick 206 is in the melt station 230 may permit, gravity to be the only factor causing the ink sticks 206 to be forced against a melt unit when the belt is stopped. If the belt 216 continues to run, however, additional sticks 206, if present, may contact the belt 216 and push against the lower stick 206, urging it toward the melt station 230.

It should be appreciated that, alternatively, the pulley 218 may be positioned low enough that the ink stick 206 may be in contact with the pulley 218 when the stick 206 is in the melt station 230. With such configuration, the belt 216 may insure sufficient forces are exerted on the ink stick 206 to increase the pressure of the ink stick 206 contact against the melt unit.

Figure 9:
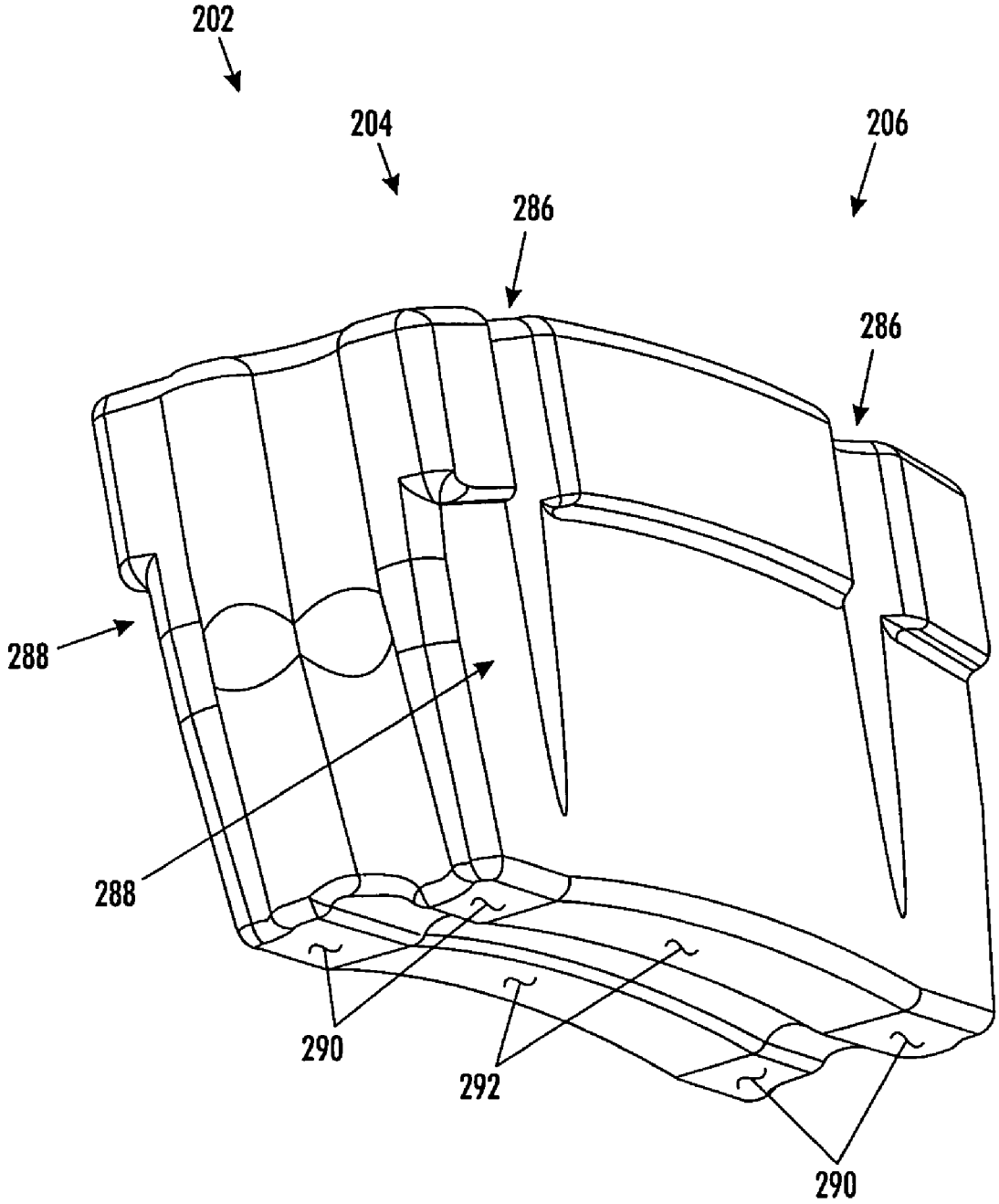
FIG. 9 is a perspective view of an ink stick for use with the guide assembly for advancing the ink sticks of the solid ink delivery system of FIG. 2 toward the melt station of the delivery system.

Referring now to FIG. 9, ink stick 206 for use with the printer 202 of FIGS. 2-8 is shown in greater detail. The ink stick 206 is shown in FIG. 9 includes a series of vertical keying features used, among other things, to differentiate sticks of different colors and different printer models. The stick keying features are used to admit or block insertion of the ink through the keyed insertion opening of the solid ink delivery system 304. The ink stick 206 further includes a series of horizontal shaped features 288 for guiding, supporting or limiting feed of the ink stick 206 along the chute feed path. It should be appreciated that that keying and shaped features can be configured to accomplish the same functions with a horizontal or other alternate chute or loading orientation.

The ink stick 206, as shown in FIG. 9, includes two spaced-apart pairs of spaced-apart nominally flat underside surface portions 290, one pair on each end of the stick 206, for accommodating the linear portions of the feed path, as well as a centrally located pair of spaced apart arcuate portions 292, to accommodate the curved or arcuate portion of the ink feed path. The ink stick groove 250 which separates the pairs, likewise has linear and arcuate portions.

Referring now to FIG. 10, the ink stick 206 is shown in position on a linear portion of the belt 216 of the solid ink delivery system 204 of the printer 202. The ink stick 206 contacts the belt 216 at the end portions 290 of the ink stick 206 and the groove 250 formed in the ink stick 206 cooperates with the belt 216 to influence position and advance the stick 206. As shown in FIG. 10, the ink stick 206 is arcuate or curved along longitudinal axis 294.

Figure 11:
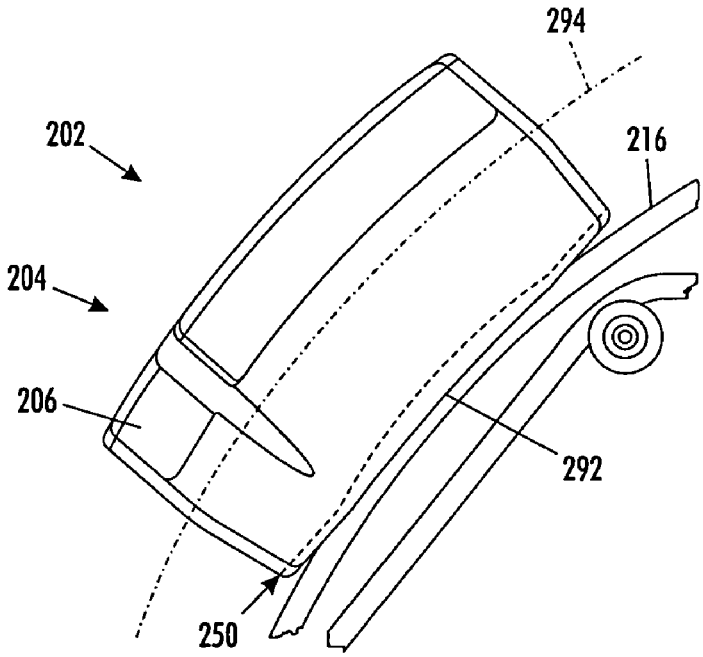
FIG. 11 is an plan view of the ink stick of FIG. 9 in position on a curved portion of the drive member of the delivery system of FIG. 7.

Referring to FIG. 11, the ink stick 206 is shown in position along an arcuate portion of the belt 216. As shown in FIG. 11, the central arcuate portion 292 of the solid in stick 206 engages with the belt 216.

Figure 12:
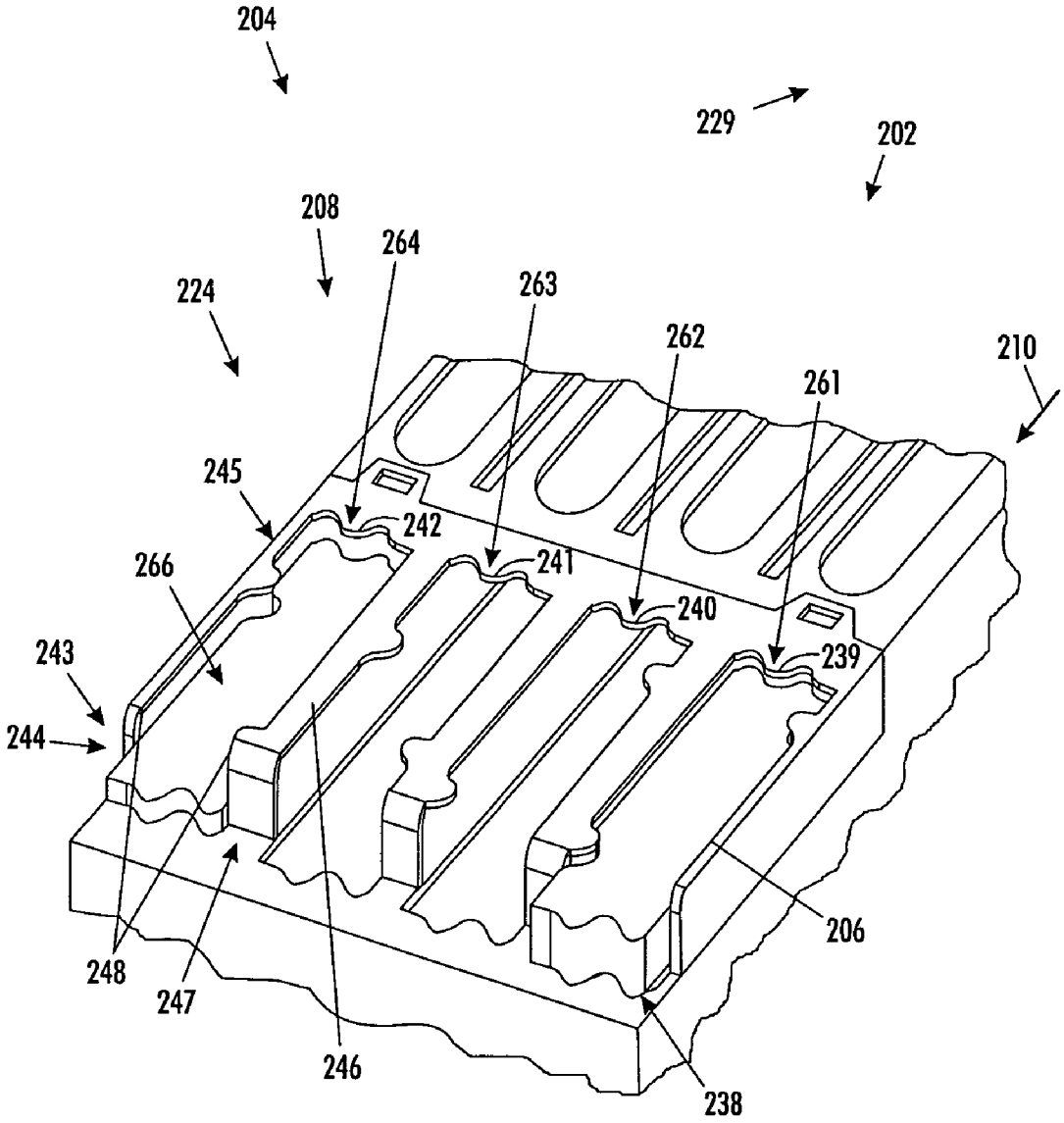
FIG. 12 is a perspective view of the loading station of the solid ink delivery system of FIG. 2 showing a triangularly formed grasping recess at the end of the chute constraints for inserting and/or retrieving a stick from the chute at the loading station according to the system disclosed herein.

Referring now to FIG. 12, loading station 224 of the printer 202 is shown in greater detail. The loading station 224 of the solid ink delivery system 204 includes a key plate 238 which is used to assure that only the proper stick is positioned in the proper chute of the solid ink deliver system 204. For example and as shown in FIG. 12, the key plate 238 includes a black key plate opening 239, a cyan key plate opening 240 and a magenta key plate opening 241. The key plate 238 further includes a yellow key plate opening 242. The key plate openings 239, 240, 241, and 242 include key features, in the example protrusions 253 formed in the key plate 238. Keyed openings may be in separate plates or may be formed as part of the chute or other chute/guide constraints.

The protrusions 253, as shown in FIG. 12, are positioned differently for each of the openings 239-242 such that only the proper respective ink stick may be fitted into the respective opening of the key plate 238. The sticks 206 may include inset features 244 that correspond to the protrusions 253.

As shown in FIG. 12, the sticks 206 are inserted into the loading position through an insertion opening in the key plate 238. Once the sticks 206 are placed in the loading position it becomes more difficult to remove the sticks 206 from the chute 208. To alleviate the difficulty in removing the sticks 206 from the openings, the key plate 238 of the loading station 224 includes an ink stick grasping recess 243 for accessing the sticks once they are inserted. This feature may also be beneficial in placing the sticks into the load position.

The grasping recess feature 243 may, as shown in FIG. 12, be in the form of a truncated or recessed constraining element. For example, the grasping recess 243 may include a first recess 244 which is in the form of a void area or removed section of, for example, first constraining panel 245 of the yellow opening 242 of the key plate 238. Similarly the second constraining panel 246 that forms the yellow opening 242 of the key plate 238 includes a second or opposed grasping recess 247. The first grasping recess 244 and the second grasping recess 247 may have any suitable shape and may, for simplicity, be in the form of, for example, a generally rectangularly formed notch. The use of the grasping recesses 244 and 247 permits the fingers of the operator to grasp the stick 206. FIG. 12 shows the rear portion of key plate 238 to be recessed relative to the major upper surface, thereby creating the grasping recesses 244 and 247. Constraining panels or similar ink stick constraints may be referred to as walls in the following descriptions.

As shown in FIG. 12, the grasping recess 243 may be utilized for each of the four stick openings, for example, for black key plate opening 239, for cyan key plate opening 240, for magenta key plate opening 241, and for yellow key plate opening 242.

Figure 13:
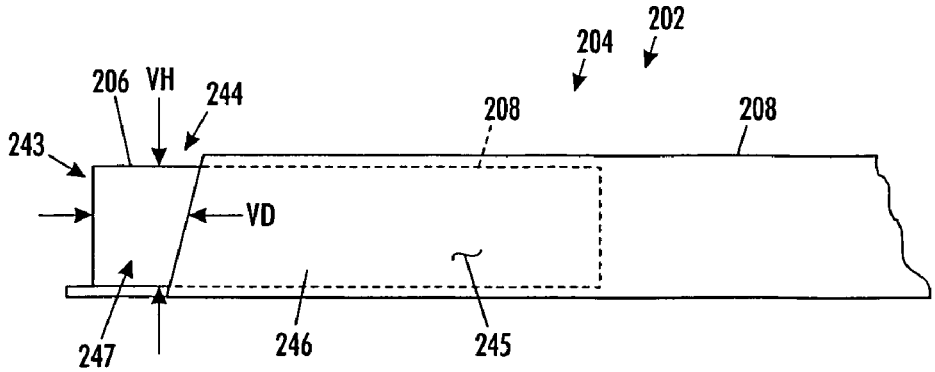
FIG. 13 is a plan view of the loading station of FIG. 12.

Referring now to FIG. 13, the grasping recess 243 is shown formed in walls 246 and 245 of the chute 208. The first wall 245 defines first grasping recess 244 while second wall 246 defines second grasping recess 247. The first grasping recess 244 and the second grasping recess 247, for simplicity and optimal utilization, are positioned opposed from each other with the stick 206 positioned in the chute 208 between the first grasping recess 244 and the second grasping recess 247. The grasping recesses 244 and 247 may have a generally rectangular shape and be defined by a recess depth VD and a recess height VH. Opposing grasping recesses need not be fully or even partially aligned to one another (common distance from an end) to facilitate ink stick insertion or removal from the chute. Though opposed recesses may generally be depicted with such alignment it is to be understood that opposed recesses may be aligned or not aligned.

Figure 14:
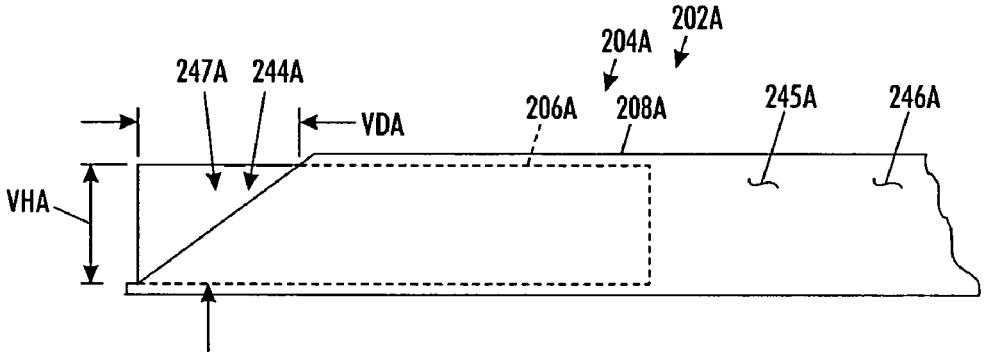
FIG. 14 is a plan view of a loading station of an solid ink delivery system showing a rectangularly formed grasping recess at the end of the chute constraint walls for inserting and/or retrieving a stick from the chute at the loading station according to another embodiment of the system disclosed herein.

Referring now to FIG. 14, yet another embodiment of the system disclosed herein is shown as solid ink delivery system 204A for use in printer 202A. The solid ink delivery system 204A utilizes sticks 206A and is similar to the solid ink delivery system 204 of FIGS. 1-13 except that the solid ink delivery system 204A includes a grasping recess 243A that is somewhat different than the grasping recess 243 of the solid ink delivery system 204 of FIGS. 1-13.

For example and as shown in FIG. 14, the grasping recess 243A includes a first recess 244A formed in first wall 245A of chute 208A and a second recess 247A formed in second wall 246A of chute 208A. The first recess 244A and second recess 247A have a generally triangular shape and are defined by the recess depth VDA and a recess height VHA. The recesses 244A and 247A are triangular.

Figure 15:
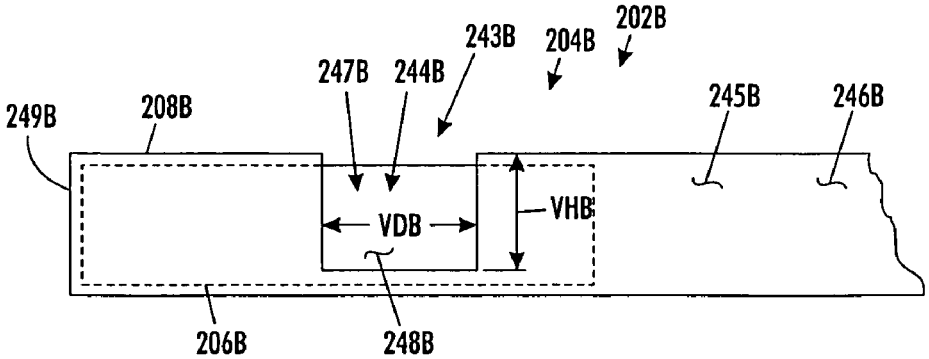
FIG. 15 is a plan view of a loading station of an solid ink delivery system showing a rectangularly formed grasping recess spaced from the end of the chute constraint wall for inserting and/or retrieving a stick from the chute at the loading station according to another embodiment of the system disclosed herein.

Referring now to FIG. 15, yet another embodiment of the system disclosed herein is shown as solid ink delivery system 204B for use in printer 202B. The solid ink delivery system 204B includes a grasping recess 243B that is somewhat different than the grasping recess 243 of FIGS. 1-13. The grasping recess 243B is positioned spaced from end 249B of the chute 208B. The grasping recess 243B is in the forms of opposed recesses, for example, a first recess 244B is formed in first wall 245B and a second recess 247B is formed in second wall 246B. The first recess 244B and the second recess 247B have a generally rectangularly formed shaped defined by recess depth VDB and a recess height VHB. The recesses 244B and 247B are spaced from end 249B of the chute 208B. As shown in FIG. 15, the recesses 244B and 247B are positioned opposed to each other so that opposed surfaces 248B of the stick 206B may be readily accessed.

Figure 16:
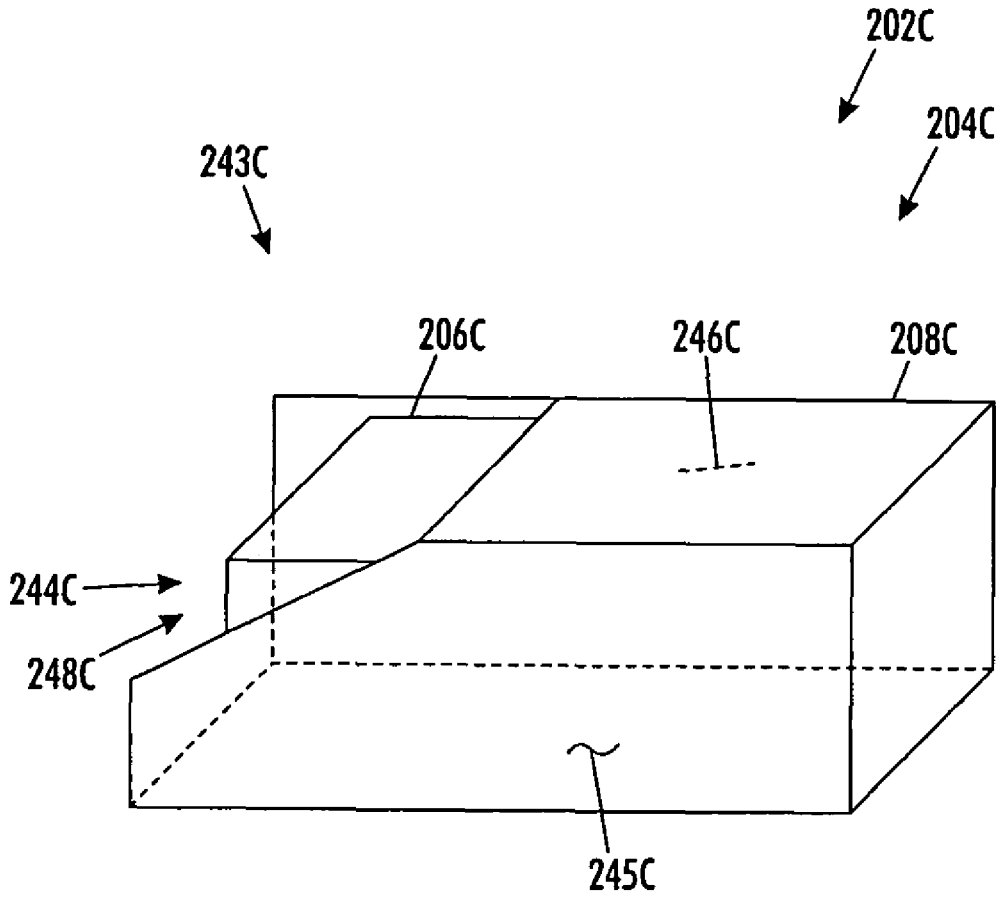
FIG. 16 is a perspective view of a loading station of an solid ink delivery system showing a triangularly formed grasping recess at the end of the chute on one side of the chute for inserting and/or retrieving a stick from the chute at the loading station according to another embodiment of the system disclosed herein.

Referring now to FIG. 16, yet another embodiment of the system disclosed herein is shown as solid ink delivery system 204C for use with printer 202C. The solid ink delivery system 204C of FIG. 16 includes a grasping recess 243C that is somewhat different from the grasping recess 243 of the printer 202 of FIGS. 1-13. The grasping recess 243C is in the form of a solitary recess 244C formed in first wall 245C of the chute 208C. The chute 208C includes a second wall 246C spaced from first wall 245C. The second wall 246C does not include a recess. The grasping recess 243C requires the operator to contact one of the opposed surfaces 248C of the stick 206C and press against the surface 248C such that the stick 206C is urged against second wall 246C and then upwardly along wall 246C, thus permitting the operator to remove the stick 206C from the chute 208C.

Referring now to FIGS. 35 and 36, yet another embodiment of the system disclosed herein is shown as solid ink delivery system 204D for use with printer 202D. Referring now to FIG. 35, loading station 224D of the printer 202D is shown in greater detail. The loading station 224D of the solid ink delivery system 204D includes a key plate 238D similar to the key plate 238 of the printer 202 of FIG. 12 which is used to assure that only the proper stick is positioned in the proper chute of the solid ink deliver system 204. For example and as shown in FIG. 35, the key plate 238D includes a black key plate opening 239D, a cyan key plate opening 240D and a magenta key plate opening 241D. The key plate 238D further includes a yellow key plate opening 242D. The key plate openings 239D, 240D, 241D, and 242D include key features, in the example protrusions 243D formed in the key plate 238D. Keyed openings may be in separate plates or may be formed as part of the chute or other chute/guide constraints.

The protrusions 243D, as shown in FIGS. 35 and 36 are positioned differently for each of the openings 239D-242D such that only the proper respective ink stick may be fitted into the respective opening of the key plate 238D. The sticks 206D may include inset features 244D that correspond to the protrusions 243D.

As shown in FIGS. 35 and 36, the sticks 206D are inserted into the loading position through an insertion opening in the key plate 238D. Once the sticks 206D are placed in the loading position it becomes more difficult to remove the sticks 206D from the chute 208D. To alleviate the difficulty in removing the sticks 206D from the openings, the key plate 238D of the loading station 224D includes an ink stick grasping recess 243D for accessing the sticks once they are inserted. This feature may also be beneficial in placing the sticks into the load position.

The grasping recess feature 243D may, as shown in FIGS. 35 and 36, be in the form of a truncated or recessed constraining element. For example, the grasping recess 243D may include a first recess 244D which is in the form of a void area or removed section of, for example, first constraining panel 245D of the yellow opening 242D of the key plate 238D. Similarly the second constraining panel 246D that forms the yellow opening 242D of the key plate 238 D includes a second or opposed grasping recess 247D. The first grasping recess 244D and the second grasping recess 247D may have any suitable shape and may, for simplicity, be in the form of, for example, a generally rectangularly formed notch. The use of the grasping recesses 244D and 247D permits the fingers of the operator to grasp the stick 206D. FIGS. 35 and 36 show the rear portion of key plate 238D to be recessed relative to the major upper surface, thereby creating the grasping recesses 244D and 247D. Constraining panels or similar ink stick constraints may be referred to as walls in the following descriptions.

As shown in FIGS. 35 and 36, the grasping recess 243D may be utilized at least for two of the four stick openings, for example, for cyan key plate opening 240D and for yellow key plate opening 242D.

As shown in FIGS. 35 and 36, walls 281D and 283D are positioned on opposed sides of the key plate 238D. The walls 281D and 283D interfere with access to the outer sides 285D of the ink sticks 206D at the magenta key plate opening 241D and the black key plate opening 239D, respectively, that would otherwise be provided by the grasping recess 243D. The grasping recess 243D does, however, provide access to first end 287D of the magenta ink stick 206D and to first end 289D of the black ink stick 206D.

To provide access to second end 291D of the magenta ink stick 206D, the magenta key plate opening 241D further includes a magenta finger access cutout 293D. Similarly, the black key plate opening 239D further includes a black finger access cutout 295D to provide access to second end 297D of the black ink stick 206D.

The cutouts 293D and 295D, as shown in FIG. 36, may have an arcuate shape to conform to the periphery of a human finger. By utilizing the black finger access cutout 295D and the grasping recess 243D the first end 289D and the second end 297D of the black ink stick 206D may be grasped by, for example, the thumb and middle finger and the black ink stick 206D may be lifted vertically through the key plate 238D and out of the printer 202D.

Similarly, by utilizing the magenta finger access cutout 293D and the grasping recess 243D, the first end 287D and the second end 291D of the magenta ink stick 206D may be grasped by, for example, the thumb and middle finger and the magenta ink stick 206D may be lifted vertically through the key plate 238D and out of the printer 202D.

Figure 17:
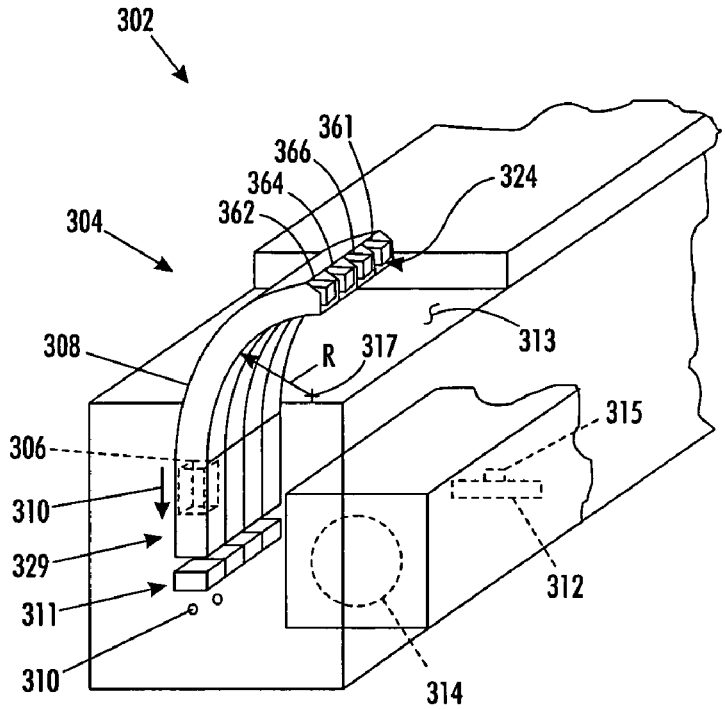
FIG. 17 is a partial perspective view of another embodiment of a solid ink delivery system for delivering solid ink stock to a melting station for converting the solid ink into liquid form for delivery to print heads of the printer.

According to the system disclosed herein and referring now to FIG. 17, a solid ink printer 302 is shown. The printer 302 includes a solid ink delivery system 304 for use with an ink stick 306. The printer 302 includes the solid ink delivery system 304 for delivering the ink stick 306 to a melting station where a melting unit 311 is used to melt the ink stick 306. The ink in the ink stick 306 is transferred from a solid to a liquid and the liquid ink 305 is transferred to media, for example, a sheet of paper 312, by a drum 314 to form an image 315 on the paper 312. The solid ink delivery system 304 includes a guide 308 for guiding the ink stick 306 in a prescribed path 310. The guide 308 may be, for example, in the form of a channel or chute. The guide 308 defines a loading station 324 to permit the ink stick 306 to be placed into the guide or chute 308.

The chute 308 also defines a delivery station 329 adjacent to the melting unit 311. The loading station 324 is located above the delivery station 329 in the illustrated configuration. The ink stick 306 is slideably fitted to the chute 308 whereby only gravity advances the ink stick 306 through all or any portion of the chute angled to allow gravity to act as the moving force from the loading station 324 to the delivery station 329.

It should be appreciated that the chute 308 may have any suitable shape such that the sticks 306 feed by gravity from loading station 324, that may be positioned near, for example, the printer top work surface 313, toward the melting unit 311. The chute 308 may include linear and arcuate portions, be completely linear or may, as is shown in FIG. 17, be of a continuous arcuate shape defined by a radius R extending from the origin 317. It should be appreciated that origin 317 may be positioned anywhere with respect to the chute 308 and that the radius R may be constant, or, as is shown in FIG. 17, vary such that the radius R may increase such that the chute is virtually vertical near the melting unit 311. It should be obvious that any portion of the chute that has a non constant radius will not have a radius that extends from a specific origin. This consideration applies to all descriptions and illustrations.

Figure 18:
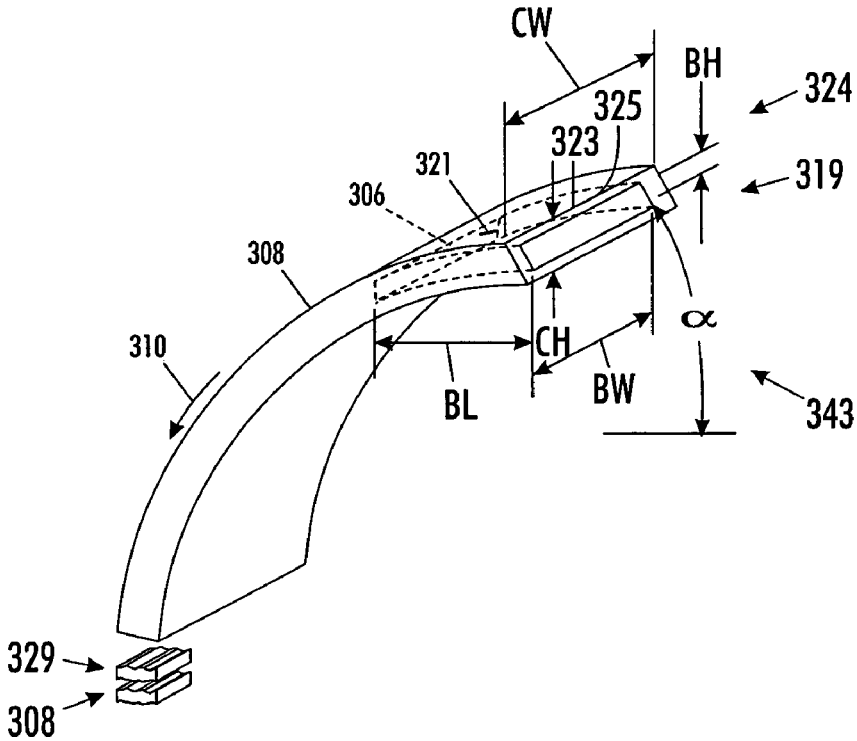
FIG. 18 is a partial perspective view of the chute of the solid ink delivery system of FIG. 18.

Referring now to FIG. 18, it should be appreciated that the chute 308 forms a stick opening 319 in a suitable size and shape and to provide for the uniform movement of the sticks 306 down the chute 308 along the path 310. To avoid cross loading or jamming of the sticks 306 in the chute 308, the sticks 306 may have an external periphery 321 which closely conforms with internal periphery 323 formed in the stick opening 319 of the chute 308 or other panel or plate coupled to the chute. The insertion opening may be parallel, perpendicular or at any intermediate angle relative to any portion of the chute feed path.

Feed of the ink sticks can be entirely influenced by gravity. For example, and as is shown in FIG. 18, the sticks 306 may be rectangular and the stick opening 319 of the chute 308 may be rectangular and slightly larger than the sticks 306 to provide the ability of the sticks 306 to feed by gravity down the chute 308. For example, and as shown in FIG. 18, the sticks have a stick length BL, a stick height BH, and a stick width BW. The stick opening 319 of the chute 308 may be defined by a chute height CH slightly larger than the stick height BH and a chute width CW slightly wider than the stick width BW.

In a more ideal configuration, the sticks and insertion opening would include complementary keying features to exclude sticks of the wrong color or a different model.

Further to assure that the sticks 306 feed by gravity down the opening 319 of the chute 308 and as is shown in FIG. 18, the bottom surface 325 of the chute opening 319 may form an angle a with the horizontal plane such that the force of gravity exceeds the nominal coefficient of friction between the sticks 306 and the chute bottom surface 325 such that the sticks advance along the path 310 from the loading station 324 to the delivery station 329. A non-stick surface may be applied to the bottom surface 325, such as PTFE or any other friction reducing material or coating.

Referring again to FIG. 17, the printer 302, as shown in FIG. 3, is a color ink printer. The chute 308, as shown in FIG. 17, include a first black chute 361, a second cyan ink chute 362, a third magenta ink chute 366, and a fourth yellow ink chute 364. The four ink chutes 361, 362, 364 and 366 may each have their respective keys to provide for the entry of only the proper ink stick. It should be appreciated that the printer of the system disclosed herein may be a black or mono-chrome printer having a solitary chute or multiple chutes.

Figure 19:
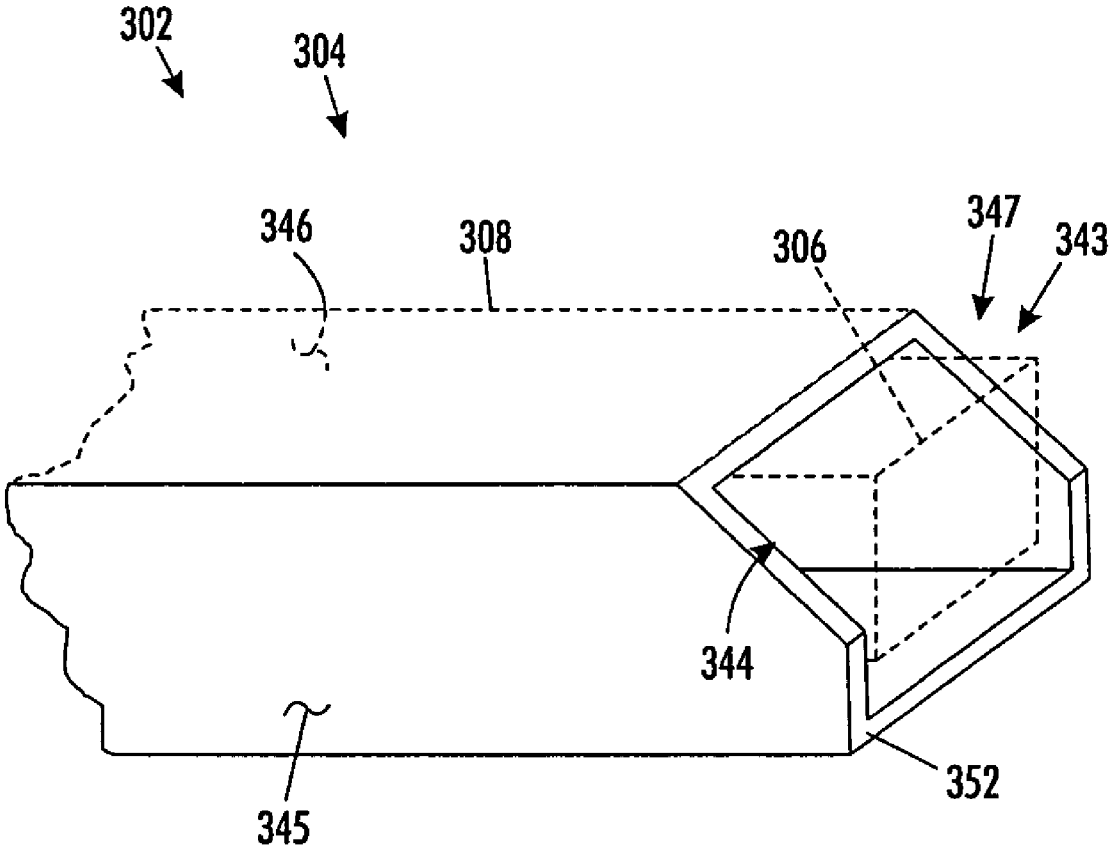
FIG. 19 is a perspective view of the loading station of the solid ink delivery system of FIG. 17 showing a triangularly formed grasping recess at the end of the chute for inserting and/or retrieving a stick from the chute at the loading station according to another embodiment of the system disclosed herein.

Referring now to FIGS. 17, 18 and 19, grasping recess 343 is shown in position at loading station 324 of solid ink delivery system 304 of printer 302. The grasping recess 343, as shown in FIG. 19, is in the form of a first recess 344 formed from first wall 345 of the chute 308 and a second spaced apart recess 347 formed from second wall 346 of the chute 308. The first recess 344 and the second recess 347 are spaced apart and in alignment with each other and have, as shown in FIG. 19, a generally triangularly formed shape. The first recess 344 and the second recess 347 are located at end 352 of the chute 308.

Figure 20:
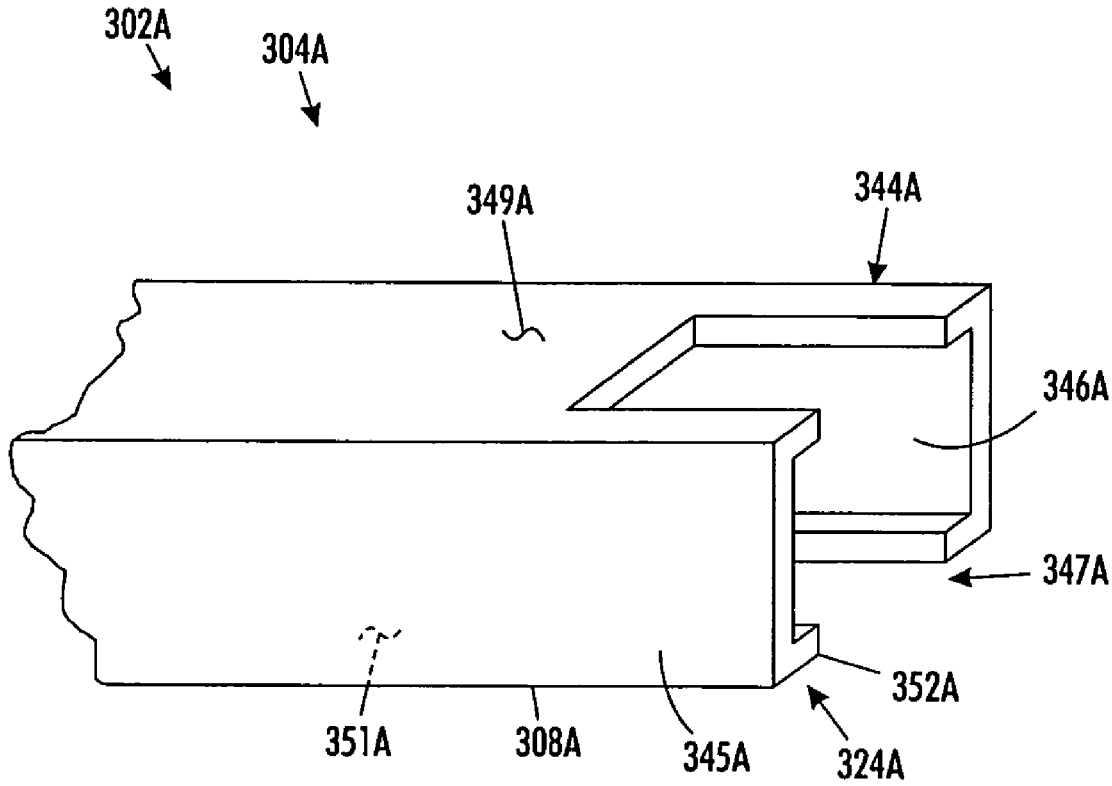
FIG. 20 is a partial perspective view of another embodiment of the solid ink delivery system of the system disclosed herein with opposed recess on the top and bottom of the guide chute.

Referring now to FIG. 20, another embodiment of the system disclosed herein is shown as solid ink delivery system 304A for use in ink printer 302A. The solid ink delivery system 304A includes a grasping recess 343A in the form of a first recess 344A formed in top wall 349A and a spaced apart second recess 347A formed in bottom wall 351A. The top wall 349A and the bottom wall 351A represent horizontal walls. The first side wall 345A and the second side wall 346A do not include the recesses. The first recess 344A and the second recess 347A extend from end 352 of the chute 308A.

Figure 21:
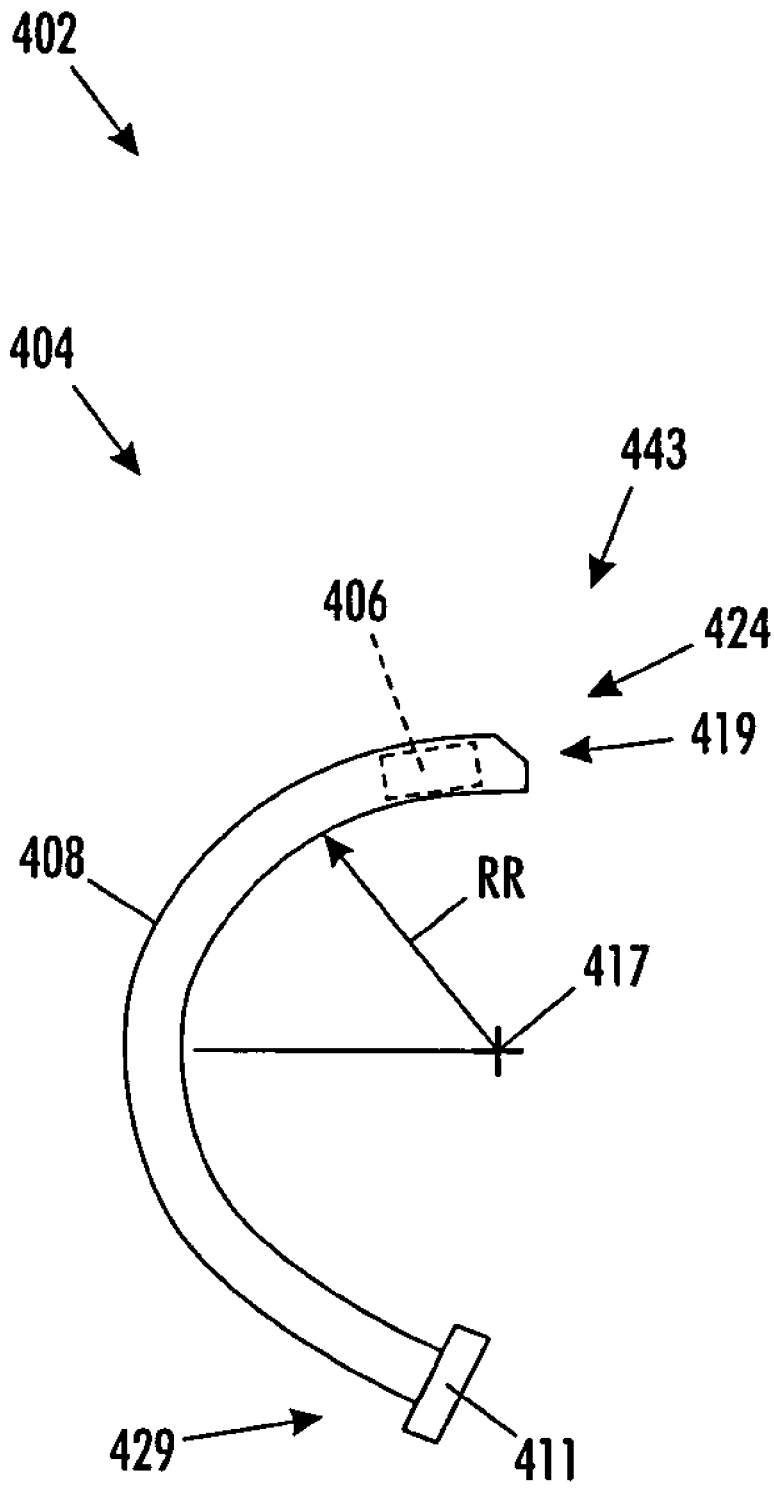
FIG. 21 is a partial plan view of another embodiment of the solid ink delivery system of the system disclosed herein with a chute that has a portion that extends underneath another portion of the chute and has a triangularly formed grasping recess at the end of the chute for inserting and/or retrieving a stick from the chute.

According to the system disclosed herein, and referring now to FIG. 21, another embodiment of the system disclosed herein is shown as ink printer 402 which includes solid ink delivery ink system 404 that is somewhat different than the solid ink delivery system 204 of the ink printer 302 of FIGS. 18-20. The solid ink delivery system 404 of FIG. 21 includes a chute 408 which is different than the chute 308 of the solid ink delivery system 304 of FIGS. 18-20. The chute 408 is similarly an arcuate chute and is defined by radius RR extending from origin 426. The radius RR may be constant or may vary, for example, increase.

The chute 408, as shown in FIG. 21, has a path that crosses over itself, or in other words the upper portions of the chute 408 may be positioned over the lower portions of chute 408. A chute configuration such as chute 408 may be conservative of space, that is, minimally intrusive or accommodating of general printer configuration constraints and other components or functions. It should be appreciated that the chute 408 may lie in a single plane or in a plurality of non-parallel planes. In other words, the chute 408 may form, for example, a spiral shape or a helical shape.

The chute 408 may have any size and shape and opening 419 may, for example, be rectangular, triangular, pentagonal, or have any other shape. The size and shape of the opening 419 of the chute 408 is preferably complementary to the size and shape of the ink stick 406 to be positioned in the chute 408 so that the stick 406 may freely feed by gravity down any portion of the chute 408 that may be so angled from the loading station 424 to delivery station 429 adjacent melting units 411.

Figure 22:
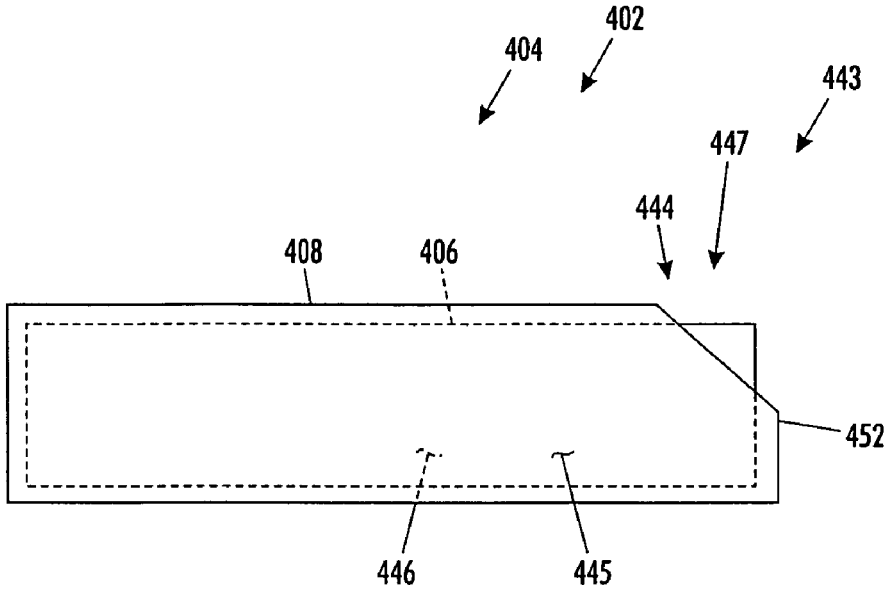
FIG. 22 is a plan view of the chute of the solid ink delivery system of FIG. 21 showing the access area in greater detail.

Referring now to FIGS. 21 and 22, the solid ink delivery ink system 404 of the printer 402 includes a grasping recess 443 for accessing sticks 406 when loaded into the chute 408.

Referring to FIG. 22, the grasping recess 443 of the chute 408 is shown in greater detail. The grasping recess 443 is in the form of a first recess 444 formed in first wall 445 of the chute and a second recess 447 formed in second vertical wall 446 of the chute 408. The first recess 444 and second recess 447 are spaced from each other and located at end 452 of the chute 408.

Figure 22A:
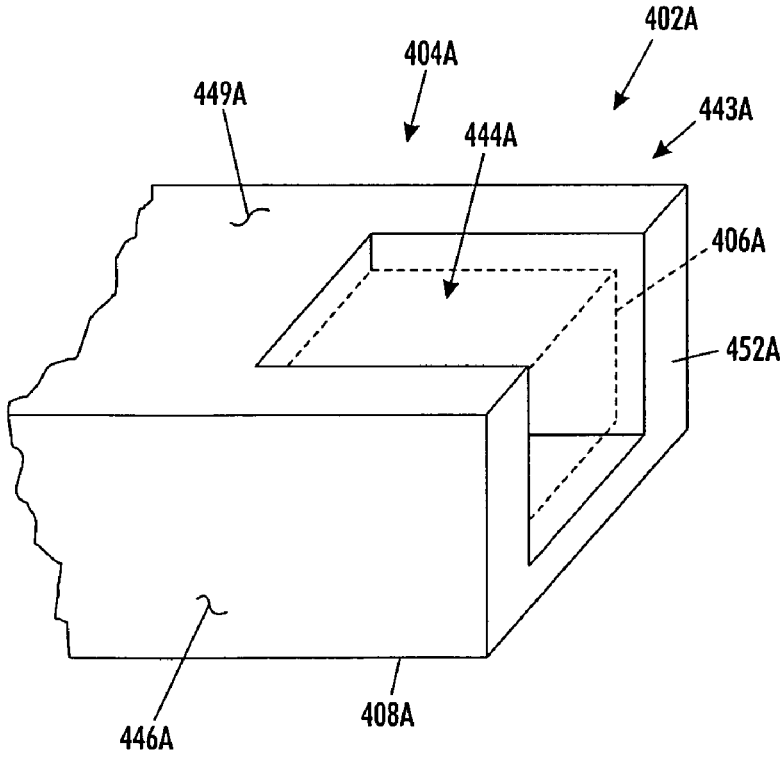
FIG. 22A is a partial perspective view of another embodiment of the solid ink delivery system of the system disclosed herein with a void in the top wall of the chute.

Referring now to FIG. 22A, yet another embodiment of the system disclosed herein is shown as solid ink delivery system 404A of printer 402A. The solid ink delivery system 404A is similar to the solid ink delivery system 404 of FIGS. 21 and 22 except that the solid ink delivery system 404A includes a grasping recess 443A that includes a solitary recess 444A formed in top wall 449A of the chute 408A. The recess 444A provides access to the ink stick 406A. The recess 444A is positioned at end 452A of the chute 408A.

Referring now to FIGS. 21 and 22, the solid ink delivery ink system 404 of the printer 402 includes a grasping recess 443 for accessing sticks 406 when loaded into the chute 408.

Referring to FIG. 22, the grasping recess 443 of the chute 408 is shown in greater detail. The grasping recess 443 is in the form of a first recess 444 formed in first wall 445 of the chute and a second recess 447 formed in second vertical wall 446 of the chute 408. The first recess 444 and second recess 447 are spaced from each other and located at end 452 of the chute 408.

Referring now to FIG. 22A, yet another embodiment of the system disclosed herein is shown as solid ink delivery system 404A of printer 402A. The solid ink delivery system 404A is similar to the solid ink delivery system 404 of FIGS. 21 and 22 except that the solid ink delivery system 404A includes a grasping recess 443A that includes a solitary recess 444 formed in top wall 449 of the chute 408. The recess 444A provides access to the ink stick 406A. The recess 444A is positioned at end 452A of the chute 408A.

Figure 23:
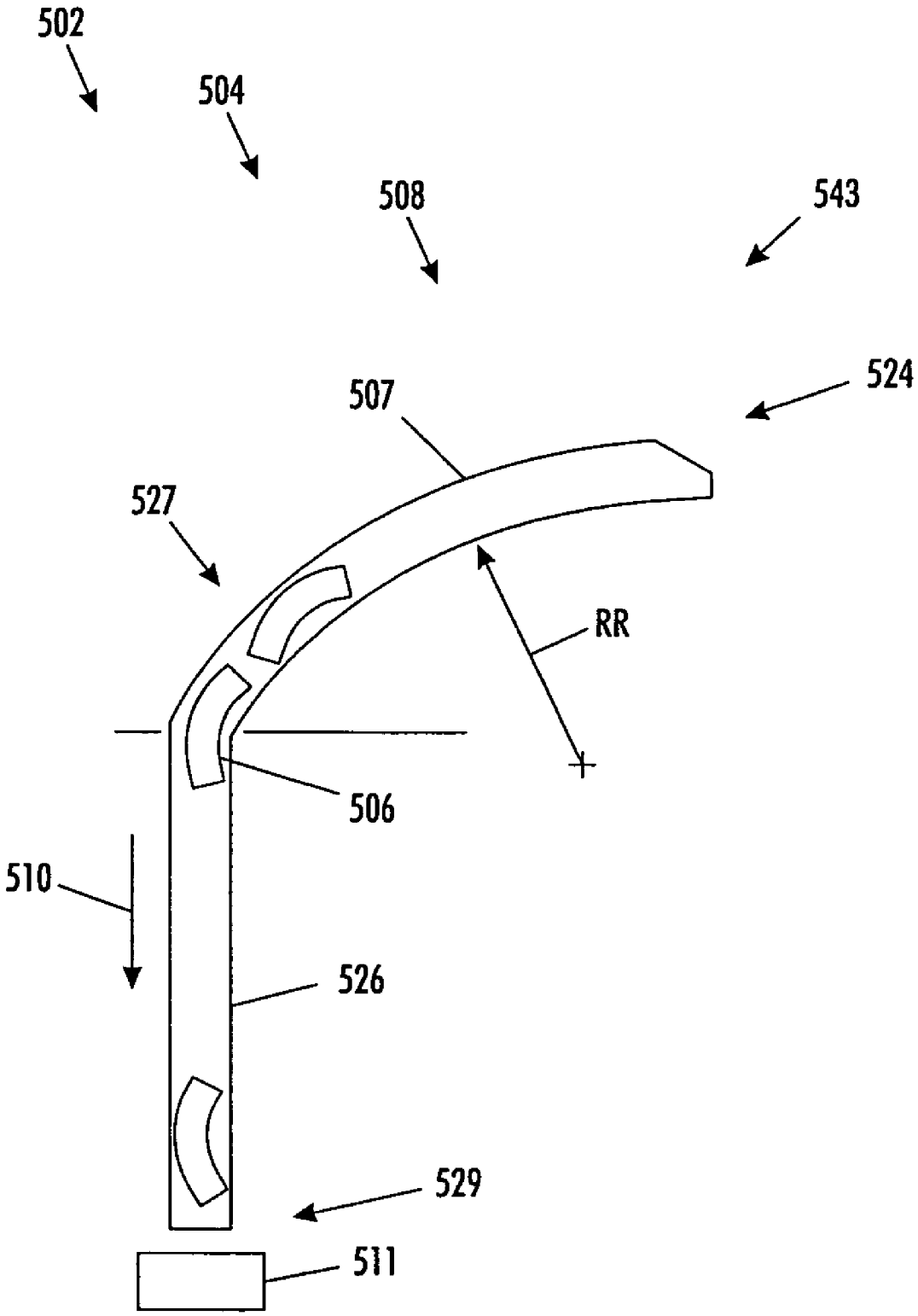
FIG. 23 is a plan view of a further embodiment of the solid ink delivery system of the system disclosed herein in the form of a solid ink delivery system with a chute having a linear portion and a curved portion.

Referring now to FIG. 23, yet another embodiment of the system disclosed herein is shown as solid ink printer 502. The printer 502 includes a solid ink delivery system 504 that has a chute 508 that includes an arcuate upper portion 507 and a linear lower portion 526. The arcuate upper portion 507 may extend from the loading station 524 to transition position 527 located between the arcuate upper portion 507 and the linear lower portion 526 of the chute 508. The arcuate upper portion 507 may be defined by radius RRR extending from origin 517. The linear lower portion 526 extends from the transition position 527 to delivery station 529 adjacent melting unit 511. The linear lower portion 526, as shown in FIG. 22, may be vertical. It should be appreciated that the linear portion 526 may, alternatively, be angled.

The ink stick 506 for use in the printer 502 may be rectangular or may, as is shown in FIG. 23, be arcuate. The arcuate shape of the ink stick 506 permits the motion of the stick 506 through the arcuate upper portion 507 and the transition position 527 of the chute 508.

Figure 24:
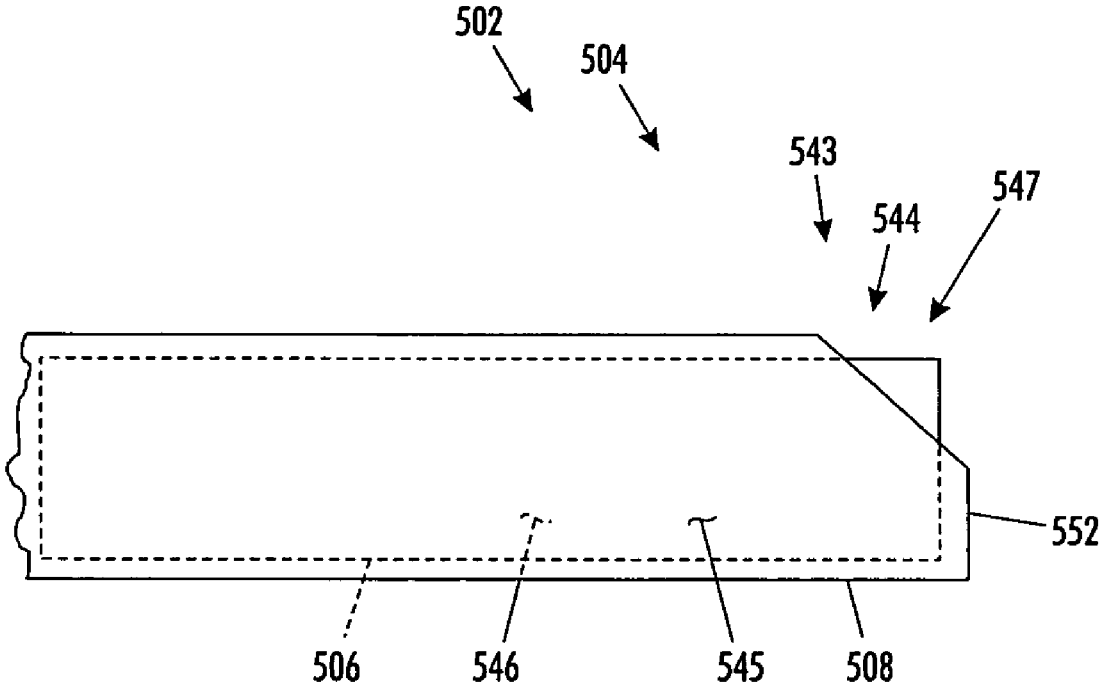
FIG. 24 is a plan view of the loading station of the solid ink delivery system of FIG. 23 showing a triangularly formed grasping recess at the end of the chute for inserting and/or retrieving a stick from the chute at the loading station according to another embodiment of the system disclosed herein.

Referring now to FIGS. 23 and 24, yet another embodiment of the system disclosed herein is shown as the solid ink delivery system 504 of the printer 502. The solid ink delivery system 504 includes a grasping recess 543 in the form of, for example, opposed recesses 544 formed in first vertical wall 545 and second recess 547 formed in second vertical wall 546. The first recess 544 and the second recess 547 extend from end 552 of the chute 508. The recesses 544 and 547 are, as shown in FIGS. 23 and 24, generally triangular.

Referring now to FIG. 25, yet another embodiment of the system disclosed herein is shown as printer 602. The printer 602 includes a solid ink delivery system 604 which has a chute 608 which is different than the chute 508 of the printer 504 of FIG. 23. The chute 608 receives the sticks 606. The chute 608 includes a first linear portion 607 that forms an angle $\alpha\alpha$ with respect to the vertical and a second linear portion 626 that forms an angle $\beta$ with the vertical. The first portion 607 and the second portion 626 form an angle $\theta$ there between.

Referring now to FIG. 24 the solid ink delivery system 604 of the printer 602 includes a grasping recess 643 according to the system disclosed herein. The grasping recess 643 includes spaced apart triangular shaped recesses 644 and 647. The first recess 644 is formed in first vertical wall 645 and the second recess 647 is formed in second vertical side wall 646. The recesses 644 and 647 are positioned at end 652 of the chute 608.

Referring now to FIG. 26, another embodiment of the system disclosed herein is shown as printer 702. The printer 702 includes a solid ink delivery system 704 which has a chute 708 which has three separate portions for advancing sticks 706. The chute 708 includes a first linear portion 707 that extends downwardly from loading station 724. An arcuate portion 731 connects the first linear portion 707 to a second linear portion 726 that extends downwardly to delivery station 729. The first linear portion 707 forms an angle $\alpha\alpha\alpha$ with respect to the vertical, while the second linear portion 726 forms an angle $\beta\beta$ with respect to the vertical. The first linear portion 707 and the second linear portion 726 are connected by the arcuate portion 731 which defines an angle $\theta\theta$ there between as well as a radius RR2 extending from origin 717.

According to the system disclosed herein, the solid ink delivery system 704 of the printer 702, as shown in FIG. 26, includes a grasping recess 743 for accessing sticks 706 when positioned in chute 708. The grasping recess 743, as shown in FIG. 26, has a generally triangularly formed shape and includes a first recess 744 formed in first vertical side wall 745 and a spaced apart second recess 747 positioned in second side wall 746. The first recess 744 and the second recess 747 have a generally triangular shape. The recesses 744 and 747 provide access to opposed faces 748 of the stick 706 to permit extraction of the stick 706 from the chute 708.

According to the system disclosed herein and referring now to FIG. 27, yet another embodiment of the system disclosed herein is shown as printer 802. The printer 802 is similar to the printer 702 of FIG. 26 except that the printer 802 has a solid ink delivery system 804 which utilizes a different method of loading the ink sticks into the ink delivery system.

The ink delivery system 804 includes a chute 808 which delivers the sticks 806 to the delivery station 829 adjacent melting units 811. The chute 808 is a vertical chute but provides for a method different than the chute 708 of the printer 702 of FIG. 26 for delivering the stick 706 to the chute 708.

For example, and as shown in FIG. 27, the loading station 824 of the chute 808 provides for a loader 832 which has a first loading position 833 where the sticks 806 are loaded vertically downward into the loader 832. The loader 832 is then moved from the first loading position 833 as shown in phantom to the second delivery position 834 as shown in solid. When in the second delivery position 834 the sticks 806 are manually released by release lever 835 to drop into the chute 808. Release lever 835 may also be actuated by contact with a structural element engaged as the second delivery position is attained, thus requiring no additional manual release actuation.

Referring now to FIG. 28, the first loading position 833 of the loader 832 is shown in greater detail. The first loading position 833 includes vertical openings 836 into which the sticks 806 are fitably positioned. The loader 832 is then rotated in the direction of arrow 837 to the second delivery position 834, as shown in FIG. 28, and the stick 806 advances to the delivery station 829 adjacent the melting units 811.

According to the system disclosed herein and referring now to FIGS. 27, 28 and 29, the solid ink delivery system 804 of the printer 802 includes a grasping recess 843 in the form of triangular recesses. The grasping recess 843, as shown in FIG. 29, includes a first recess 844 formed in first vertical wall 845 of the chute 808. The grasping recess 843 further includes a second recess 847 formed in second wall 846 of the chute 808. The first recess 844 and the second recess 847 provide access to opposed faces 848 of the stick 806. The first recess 844 and the second recess 847 are positioned at end 852 of the chute 808.

According to the system disclosed herein and referring now to FIG. 30, yet another embodiment of the system disclosed herein is shown as solid ink delivery system 904 for printer 902. The printer 902 may be any solid ink printer. The system 904 includes a grasping recess 943 in the form of a centrally located recess formed in end 952 of the chute 908. The grasping recess 943 includes a first recess formed in first vertical wall 945 of the chute 908 and a second recess 947 formed in second wall 946 of the chute 908. The first recess 944 and the second recess 947 have a generally square shape defined by recess width VWS and recess height VHS.

Referring to FIG. 31, yet another embodiment of the system disclosed herein is shown as solid ink delivery system 1004 for use in printer 1002. The printer 1002 may be any solid ink printer. The system 1004 includes a grasping recess 1043 in the form of a recess 1044 formed in chute 1008. The recess 1044 represents a uniform recess around the stick 1006. The stick 1006 extends a distance SL from end 1052 of the chute 1008. The positioning of the stick 1006 from the end 1052 of chute 1008 provides access for the stick 1006 when put in the loading position of the solid ink delivery system 1004.

According to the system disclosed herein and referring now to FIG. 32, yet another embodiment of the system disclosed herein is shown as solid ink delivery system 1104 for use in printer 1102. The solid ink delivery system 1104 includes a grasping recess 1143 in the form of a recess 1144 formed in first vertical wall 1145 of the chute 1108. The recess 1144 is positioned a distance VE from end 1152 of the chute 1108. The recess 1144 is, as shown in FIG. 32, generally rectangular having a width VWW and a height VHW. The dimensions of the recess 1144 should be sufficient for access by a user. It should be appreciated that any grasping recess may have any suitable shape and size capable of providing insertion or removal access to a stick by a finger or thumb.

The solitary recess 1144, as shown in FIG. 32, provides for removal of the stick 1106 by pressing with the finger against face 1148 of the stick 1106 and urging the stick 1106 against second wall 1146 of the chute 1108 and pulling upward with the finger to remove the stick 1106. It should be appreciated that a second similar recess (not shown) may be positioned in opposition with the first recess 1144. The second recess would be formed in the second wall 1146.

According to the system disclosed herein and referring now to FIG. 33, yet another embodiment of the system disclosed herein is shown as grasping recess 1244 for solid ink delivery system 1204 for use with printer 1202. The term recess or grasping recess is intended to encompass all grasping access shapes/sizes in any position in the feed channel intended to aid insertion or removal of an ink stick, including a through hole or surrounded void, such as an aperture, as depicted in recess 1244. The solid ink delivery system 1204 includes a recess 1244 formed in wall 1245 of the chute 1208. The recess 1244 is spaced from end 1252 of the chute 1208.

The recess 1244 may have any suitable shape and may, for example, be square, rectangular, triangular or any shape capable of inserting a finger in the recess 1244 to urge the stick 1206 upward. It should be appreciated that a second recess 1247 may be similarly positioned in second vertical wall 1246 of the chute 1208 for assisting with the first recess 1244 in providing an access for the sticks 1206 in the chute 1208.

According to the system disclosed herein and referring now to FIG. 34, yet another embodiment of the system disclosed herein is shown as method 1300 for delivering sticks to a melting unit of a solid ink printer. The method 1300 includes a first step of 1310 of providing at least one ink stick defining a longitudinal axis of the stick and an external periphery of the stick. The method 1300 includes a second step 1312 of providing a guide for guiding the stick in a prescribed path. The guide defines a loading position spaced from the melting unit and a delivery position adjacent the melting unit. The guide at the loading station defines opposed walls for guiding the stick. A portion of the opposed walls are adapted for cooperation with the opposed surfaces of the external periphery of the stick. At least one of the opposed walls defines a recess, which can be a void, in the wall.

The method 1300 includes a third step 1314 of inserting the stick into the guide at the loading position. The method 1300 further includes a fourth step 1316 of determining if the inserted stick needs to be removed from the loading position. The method 1300 further includes a fifth step 1318 of accessing the inserted stick through the void in the wall if the inserted stick needs to be removed from the loading position.

Variations and modifications of the system disclosed herein are possible, given the above description. However, all variations and modifications which are obvious to those skilled in the art to which the system disclosed herein pertains are considered to be within the scope of the protection granted by this Letters Patent.

What is claimed is:

1. A solid ink printer ink delivery system for use with an ink stick having an external periphery with opposed surfaces, said solid ink printer delivery system configured to deliver a solid ink stick to a melting device for melting the solid ink stick to produce liquid ink, said solid ink printer delivery system comprising:

a guide for guiding the stick in a prescribed path, said guide defining a loading position to permit the stick to be placed in the guide, a delivery position adjacent the melting device, and an end at the loading position that is at an end of the guide that is opposed to an end of the guide at the delivery position, said guide at the loading position defining constraints for positioning the solid ink stick, a portion of the constraints adapted for cooperation with at least a portion of the opposed surfaces of the external periphery of the solid ink stick, at least one of the constraints defining a grasping recess located at the end of the loading position of said guide, the grasping recess providing access to a portion of at least one of the opposed surfaces of the external periphery of the solid ink stick.

2. The ink delivery system of claim 1, wherein the constraints define a second grasping recess for providing access to a portion of the opposed surfaces of the external periphery of the stick.

3. The ink delivery system of claim 1, wherein the constraints are walls.

4. The ink delivery system of claim 1:

wherein the grasping recess is located at a position spaced from the end of the loading position of said guide.

5. The ink delivery system of claim 1:

wherein each of the constraints define a grasping recess; and the grasping recesses of the constraints have a similar size and shape.

6. The ink delivery system of claim 1, wherein the constraints are vertically oriented.

7. The ink delivery system of claim 1, wherein the constraints are substantially parallel to each other.

8. The ink delivery system of claim 1, the grasping recess further comprises:

an aperture in at least one of the constraints.

9. The ink delivery system of claim 1, wherein the guide at the loading position is adapted to receive the solid ink stick in an orientation normal to a longitudinal axis of the solid stick.

10. The ink delivery system of claim 1, the guide at the loading position is adapted to receive the solid ink stick in an orientation along a longitudinal axis of the solid ink stick.

11. A printer having a solid ink delivery system for transporting solid ink sticks to a melting device within the printer to produce liquid ink, the solid ink delivery system comprising:

a guide for guiding solid ink sticks in a prescribed path within the printer, the guide having constraints at a loading position that are configured to receive a solid ink stick for movement through the guide and a delivery position at an end of the guide that is adjacent the melting device; and a grasping recess configured in a constraint to provide access to a portion of a solid ink stick within the guide at the loading position.

12. The printer of claim 11 further comprising:

a grasping recess in each constraint of the guide at the loading position.

13. The printer of claim 11:

wherein the grasping recess is located at a second end of the guide that is opposite the end of the guide adjacent the melting device.

14. The printer of claim 11, wherein the constraints are walls.

15. The printer of claim 11, wherein the constraints are substantially parallel to each other.

16. The printer of claim 11, wherein the grasping recess is configured as an aperture in at least one of the constraints.

17. The printer of claim 11 further comprising:

a second grasping recess configured in another of the constraints of the guide; and the grasping recesses of the constraints have a similar size and shape.

18. The printer of claim 11, wherein the constraints are substantially vertically oriented.

* * * * *